US011142418B2

(12) United States Patent
Hitaka

(10) Patent No.: US 11,142,418 B2
(45) Date of Patent: Oct. 12, 2021

(54) IMAGE FORMING DEVICE, PAPER FEEDING MECHANISM DETERIORATION DETERMINING METHOD AND NON-TRANSITORY RECORDING MEDIUM

(71) Applicant: KONICA MINOLTA, INC., Tokyo (JP)

(72) Inventor: Masatoshi Hitaka, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 155 days.

(21) Appl. No.: 16/594,653

(22) Filed: Oct. 7, 2019

(65) Prior Publication Data

US 2020/0122941 A1 Apr. 23, 2020

(30) Foreign Application Priority Data

Oct. 23, 2018 (JP) ..... JP2018-198938

(51) Int. Cl.

| | |
|---|---|
| ***B65H 7/18*** | (2006.01) |
| ***B65H 7/02*** | (2006.01) |
| ***B65H 5/06*** | (2006.01) |
| ***B65H 7/20*** | (2006.01) |
| ***B65H 43/00*** | (2006.01) |
| ***B65H 3/06*** | (2006.01) |

(52) U.S. Cl.

CPC ..... *B65H 7/18* (2013.01); *B65H 3/06* (2013.01); *B65H 5/06* (2013.01); *B65H 7/02* (2013.01); *B65H 7/20* (2013.01); *B65H 43/00* (2013.01); *B65H 2301/4234* (2013.01); *B65H 2511/30* (2013.01); *B65H 2511/524* (2013.01); *B65H 2513/10* (2013.01); *B65H 2513/53* (2013.01); *B65H 2515/842* (2013.01); *B65H 2601/121* (2013.01)

(58) Field of Classification Search

CPC ..... B65H 3/06; B65H 3/0669; B65H 3/5215; B65H 3/5261; B65H 7/02; B65H 7/06; B65H 7/12; B65H 7/125; B65H 7/18; B65H 7/20; B65H 2301/4234; B65H 2511/13; B65H 2511/30; B65H 2511/52; B65H 2511/524; B65H 2513/10; B65H 2513/102; B65H 2513/104; B65H 2513/50; B65H 2513/53; B65H 2515/842; B65H 2601/121

See application file for complete search history.

(56) References Cited

U.S. PATENT DOCUMENTS

2004/0188916 A1* 9/2004 Tsukamoto ..... B65H 3/5261 271/110
2020/0004191 A1* 1/2020 Fujita ..... B65H 3/06

FOREIGN PATENT DOCUMENTS

JP 2000159357 A 6/2000
JP 2018070314 A * 5/2018 ..... G03G 15/6511

* cited by examiner

*Primary Examiner* — Prasad V Gokhale
(74) *Attorney, Agent, or Firm* — Buchanan Ingersoll & Rooney PC

(57) ABSTRACT

An image forming device comprising: a tray in which multiple number of sheets are stored; a feeder that feeds the sheet stored in the tray; and a hardware processor that: measures a carrying speed of the sheet fed by the feeder; determines whether or not the measured carrying speed is affected by the following sheet; corrects the carrying speed upon determining the carrying speed is affected by the following sheet; and detects a wear status on the feeder based on the measured carrying speed or the corrected carrying speed.

23 Claims, 21 Drawing Sheets

FIG. 12

| CORRECTION COEFFICIENT C | FEEDING NUMBER COUNTING VALUE AT CALCULATION |
|---|---|
| 1.067 | 10,003 |

FIG. 14

| SHEET TYPE | CORRECTION COEFFICIENT C | FEDING NUMBER COUNTING VALUE AT CALCULATION |
|---|---|---|
| PLAIN PAPER | 1.067 | 10,003 |
| THICK PAPER 1 | 1.040 | 11,234 |
| THICK PAPER 2 | UNCALCULATED | — |

FIG. 16

CORRECTION COEFFICIENT REGISTRATION INFORMATION 39

| FED PAPER NUMBER | CORRECTION COEFFICIENT C |
|---|---|
| 0 - 4,999 | 1.067 |
| 5,000 - 9,999 | 1.063 |
| 10,000 - 14,999 | 1.058 |
| ⋮ | ⋮ |
| 295,000 - 299,999 | 1.030 |
| 300,000 - | 1.028 |

FIG. 18

CORRECTION COEFFICIENT REGISTRATION INFORMATION 39

| SHEETY TYPE | PLAIN PAPER | THICK PAPER1 | THICK PAPER2 |
|---|---|---|---|
| FED PAPER NUMBER | CORRECTION COEFFICIENT C | CORRECTION COEFFICIENT C | CORRECTION COEFFICIENT C |
| 0 - 4,999 | 1.067 | 1.065 | 1.063 |
| 5,000 - 9,999 | 1.063 | 1.061 | 1.058 |
| 10,000 - 14,999 | 1.058 | 1.055 | 1.052 |
| ⋮ | ⋮ | ⋮ | ⋮ |
| 295,000 - 299,999 | 1.030 | 1.027 | 1.024 |
| 300,000 - | 1.028 | 1.025 | 1.020 |

FIG. 19

| SHEET TYPE | FEEDING SPEED | |
|---|---|---|
| | SPEED REDUCTION SETTING: OFF | SPEED REDUCTION SETTING: ON |
| PLAIN PAPER | HIGH SPEED | MEDIUM SPEED |
| THICK PAPER1 | MEDIUM SPEED | LOW SPEED |
| THICK PAPER2 | MEDIUM SPEED | LOW SPEED |

FIG. 20

| FEEDING SPEED | CORRECTION COEFFICIENT C | FEEDING NUMBER COUNTING VALUE AT CALCULATION |
|---|---|---|
| HIGH SPEED | 1.067 | 10,003 |
| MEDIUM SPEED | 1.040 | 11,234 |
| LOW SPEED | UNCALCULATED | — |

FIG. 21

CORRECTION COEFFICIENT REGISTRATION INFORMATION 39

| FEEDING SPEED | HIGH SPEED | MEDIUM SPEED | LOW SPEED |
|---|---|---|---|
| FED PAPER NUMBER | CORRECTION COEFFICIENT C | CORRECTION COEFFICIENT C | CORRECTION COEFFICIENT C |
| 0 - 4,999 | 1.067 | 1.065 | 1.063 |
| 5,000 - 9,999 | 1.063 | 1.061 | 1.058 |
| 10,000 - 14,999 | 1.058 | 1.055 | 1.052 |
| ⋮ | ⋮ | ⋮ | ⋮ |
| 295,000 - 299,999 | 1.030 | 1.027 | 1.024 |
| 300,000 - | 1.028 | 1.025 | 1.020 |

IMAGE FORMING DEVICE, PAPER FEEDING MECHANISM DETERIORATION DETERMINING METHOD AND NON-TRANSITORY RECORDING MEDIUM

Japanese patent application No. 2018-198938 filed on Oct. 23, 2018 including description, claims, drawings, and abstract the entire disclosure is incorporated herein by reference in its entirety.

BACKGROUND

Technological Field

The present invention relates to an image forming device, a paper feeding mechanism deterioration determining method and a non-transitory recording medium. The present invention more specifically relates to a technique for determining wear and a deterioration of the paper feeding mechanism that feeds sheets.

Description of the Related Art

Image forming devices such as printers or MFPs (Multifunction Peripherals) includes paper feeding mechanisms that feed sheets such as print papers. The paper feeding mechanism includes a paper feeding roller to feeds the sheet. The paper feeding mechanism rotates the paper feeding roller in a predetermined direction so that the sheet is fed toward a predetermined carrying path. When a paper feeding operation is repeatedly performed in the image forming device, parts such as the paper feeding roller is worn and deteriorated, resulting in lower sheets conveyance capacity of the paper feeding mechanism. If wear and the deterioration status of the paper feeding mechanism is left as it is, jams easily occur at feeding of papers.

On the other hand, an image forming device that is enabled to detect wear and deterioration of the paper feeding mechanism. This known technique is introduced for example in Japanese Patent Application Laid-Open No. JP 2000-159357 A. According to the known technique, the image forming device is provided with a sensor in a predetermined position on the carrying path of the sheet. The image forming device measures a feeding time from a time to start of feeding the sheet to a time when the sheet passes through the position of the sensor so that is enabled to detect wear and the deterioration status of the paper feeding mechanism.

The paper feeding mechanism generally includes a pick-up roller, a paper feeding roller and a separation roller. The pick-up roller is in contact with an upper surface of the sheet stored in a paper delivery tray. The pick-up roller rotates in a predetermined direction in response to the start of feeding the paper and feeds out the sheet. The pick-up roller does not always feeds out a single sheet. The pick-up roller sometimes feeds out multiple sheets at the same time to downstream. An event that the multiple sheets are fed out at the same time by the pick-up roller is called "multifeeding."

The paper feeding roller and the separation roller have a function to separate the multiple sheets when the multifeeding occurs. To be more specific, the paper feeding roller and the separation roller are arranged to face each other via the carrying path of the sheets in downstream of the pick-up roller. The paper feeding roller and the separation roller feed out only the first sheet placed on the top of the multiple sheets that are multifed to downstream of the carrying path, and the separation roller stops feeding the sheet after the second one.

Some paper feeding mechanisms stop the sheet after the second one at a position of the separation roller when the multiple sheets are multifed. In such a case, wear and the deterioration status of the paper feeding mechanism cannot be accurately detected just by measuring the paper feeding time from the time of starting feeding the sheet to the time the sheet passes through the sensor position as described in the known technique. That is because, different speed may be applied to the sheet fed out to downstream of the carrying path from the paper feeding roller depends on whether or not the multifeeding occurs.

When the multifeeding does not occur and only the single sheet is fed, the upper surface of the single sheet fed out by the pick-up roller is in contact with the paper feeding roller and the rear surface is in contact with the separation roller. A resistance (frictional force) to stop the feeding to downstream from the separation roller is applied to the sheet. At the same time, a conveyance force larger than the resistance is applied from the rotated and driven paper feeding roller. Thus, the sheet is fed out to downstream of the carrying path due to the conveyance force from the paper feeding roller against the resistance from the separation roller.

When the two sheets are multifed, for example, the upper surface of the first sheet fed out by the pick-up roller is in contact with the paper feeding roller and the rear surface of the second sheet is in contact with the separation roller. Only the resistance from the separation roller is applied to the second sheet, and it stops feeding the second sheet to downstream. Only the conveyance force from the paper feeding roller is applied to the first sheet, and the resistance from the separation roller is not applied. The larger conveyance force is applied to the first sheet compared to the case where multifeeding does not occur and only the single sheet is being fed. Thus, the speed applied to the sheet to feed out from the paper feeding roller to downstream becomes faster.

The speed of the sheet in downstream of the paper feeding roller will be different depending on whether or not the multifeeding occurs at the start of feeding the sheet. Wear and the deterioration status of the paper feeding mechanism cannot be accurately detected just simply by measuring the paper feeding time until the time the sheet passes through the sensor position as described in the known technique.

SUMMARY

The present invention is intended to solve the above problems. Thus, the present invention is intended to provide an image forming device, a paper feeding mechanism deterioration determining method and a non-transitory recording medium that correct a measured value while considering whether or not multifeeding occurs at paper feeding so that determining wear and a deterioration status of a paper feeding mechanism more accurately than conventional ones.

First, the present invention is directed to an image forming device.

To achieve at least one of the abovementioned objects, according to an aspect of the present invention, the image forming device reflecting one aspect of the present invention comprises: a tray in which multiple number of sheets are stored; a feeder that feeds the sheet stored in the tray; and a hardware processor that: measures a carrying speed of the sheet fed by the feeder; determines whether or not the measured carrying speed is affected by the following sheet; corrects the carrying speed upon determining the carrying speed is affected by the following sheet; and detects a wear status on the feeder based on the measured carrying speed or the corrected carrying speed.

Second, the present invention is directed to a paper feeding mechanism deterioration determining method to determine a deterioration of a paper feeding mechanism. The method is applied at an image forming device provided with the paper feeding mechanism that feeds a sheet.

To achieve at least one of the abovementioned objects, according to an aspect of the present invention, the paper feeding mechanism deterioration determining method reflecting one aspect of the present invention comprises: measuring a carrying speed of the sheet fed by the paper feeding mechanism; determining whether or not the measured carrying speed is affected by the following sheet; correcting the carrying speed upon determining that the carrying speed is affected by the following sheet; and detecting a wear status on the paper feeding mechanism based on the measured carrying speed or the corrected carrying speed.

Third, the present invention is directed to a non-transitory recording medium storing a computer readable program to be executed by a hardware processor in an image forming device provided with a paper feeding mechanism that feeds a sheet.

To achieve at least one of the abovementioned objects, according to an aspect of the present invention, the non-transitory recording medium storing a computer readable program to be executed by the hardware processor in the image forming device reflecting one aspect of the present invention causing the hardware processor to perform: measures a carrying speed of the sheet fed by the paper feeding mechanism; determines whether or not the measured carrying speed has been affected by the following sheet; corrects the carrying speed upon determining the carrying speed is affected by the following sheet; and detects a wear status on the paper feeding mechanism based on the measured carrying speed or the corrected carrying speed.

BRIEF DESCRIPTION OF THE DRAWING

The advantages and features provided by one or more embodiments of the invention will become more fully understood from the detailed description given herein below and the appended drawings which are given by way of illustration only, and thus are not intended as a definition of the limits of the present invention.

FIG. 12 illustrates an example of information relating to a correction coefficient;

FIG. 14 illustrates another example of the information relating to each correction coefficient;

FIG. 16 illustrates an example of correction coefficient registration information;

FIG. 18 illustrates an example of the correction coefficient registration information as which the correction coefficient for each type of the sheet is stored;

FIG. 19 illustrates an example of the relation between the type of the sheet and the carrying speed;

FIG. 20 illustrates an example of information including the carrying speed and the correction coefficient corresponding to the carrying speed; and FIG. 21 illustrates an example of the correction coefficient registration information as which the correction coefficient is registered in advance for each carrying speed.

DETAILED DESCRIPTION OF EMBODIMENTS

Hereinafter, one or more embodiments of the present invention will be described with reference to the drawings. However, the scope of the invention is not limited to the disclosed embodiments.

First Preferred Embodiment

Figure 1:
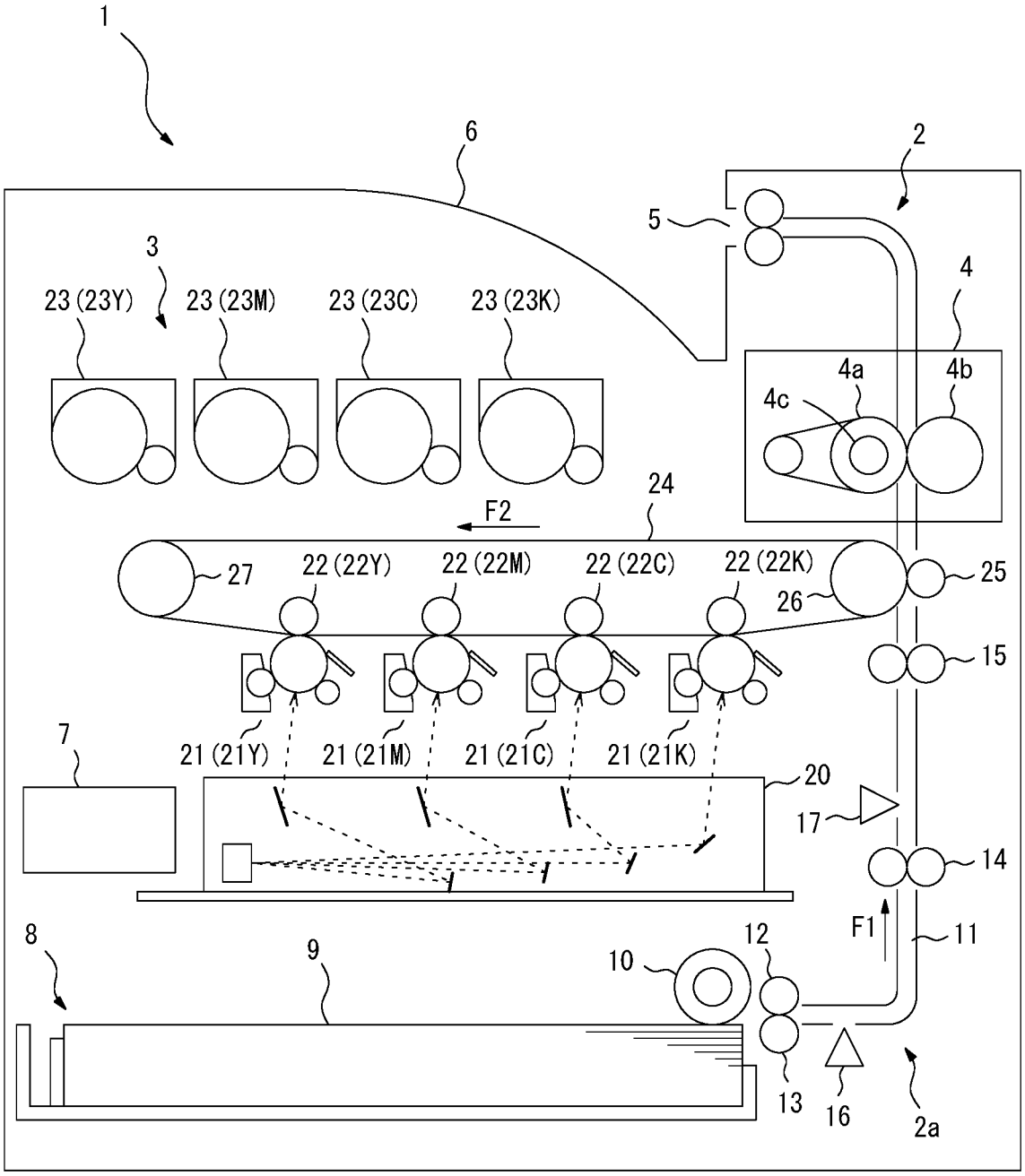
FIG. 1 illustrates an exemplary conceptual configuration of an image forming device.

FIG. 1 illustrates an exemplary conceptual configuration of an image forming device 1 in which the first preferred embodiment of the present invention may be practiced. The image forming device 1 of FIG. 1 is a printer capable of forming color images in tandem system. The image forming device 1 includes a paper feeding unit 2, an image forming unit 3 and a fixing unit 4 inside a device body. The image forming device 1 forms a color image or a black and white image on a sheet 9 such as a print paper, and delivers the sheet 9 on a paper delivery tray 6 from a paper delivery port 5 provided in an upper part of the device body. The image forming device 1 includes a controller 7 inside the device body. The controller 7 controls operations of each part such as the paper feeding unit 2, the image forming unit 3 and the fixing unit 4.

The paper feeding unit 2 includes a paper feeding tray 8, a paper feeding mechanism 2*a*, a carrying path 11, a resist roller 15 and a secondary transfer roller 25.

The paper feeding tray 8 is a container in which multiple numbers of the sheets 9 such as the print papers are stored. The sheets 9 storable in the paper feeding tray 8 are of great variety. The sheets 9 include thin papers, thick papers, plain papers, recycled papers, coated papers and OHP films, for instance. In the example of FIG. 1, a single paper feeding tray 8 is provided with the image forming device 1. The number of the paper feeding tray 8 is not limited to one. Multiple paper feeding trays 8 may be provided in multi-stages.

The paper feeding mechanism 2*a* picks up the sheet 9 stored in the paper feeding tray 8 and feeds out to the carrying path 11. The detailed structure of the paper feeding mechanism 2*a* is explained later. The carrying path 11 is a path to carry the sheet 9 in an arrow F1 direction when the image forming device 1 forms an image on the sheet 9. When a leading end of the sheet 9 carried along the carrying path 11 reaches the resist roller 15, the paper feeding unit 2, for example, stops temporarily the sheet 9 at the resist roller 15. The paper feeding unit 2 then drives the resist roller 15 in accordance with a timing that a toner image formed on an intermediate belt 24 reaches a position of the secondary transfer roller 25 in the image forming unit 3, and carries the sheet 9 to the position of the secondary transfer roller 25. As a result, the toner image is transferred to a surface of the sheet 9 when the sheet 9 passes through the position of the secondary transfer roller 25. The sheet 9 is led to the fixing unit 4 and the toner image is fixed. The sheet 9 is then delivered from the delivery port 5. The carrying path 11 of FIG. 1 shows a carrying path for forming an image only on a surface of the sheet 9. However, this is given not for limitation. To be more specific, the carrying path 11 may further include a sheet inversion path for forming an image on a rear of the sheet 9.

The image forming unit 3 forms toner images of four colors, Y (yellow), M (magenta), C (cyan) and K (black), and transfers the toner images of the four colors at the same time on the sheet 9 passing through the position of the secondary transfer roller 25. The image forming unit 3 includes an exposure unit 20, a developing unit 21, a primary transfer roller 22, the intermediate belt 24 and toner bottles 23 of the respective colors. The developing unit 21 is provided for the toner of each color. The primary transfer roller 22 is provided corresponding to each developing unit 21. Four developing units 21Y, 21M, 21C and 21K are provided in a lower position of the intermediate belt 24. The exposure unit 20 is arranged in a further lower position of the four developing units 21Y, 21M, 21C and 21K. Each of toner bottles 23Y, 23M, 23C and 23K supplies the toner of each color to the corresponding developing unit 21Y, 21M, 21C or 21K.

The exposure unit 20 exposures an image carrier (a photoreceptor drum) provided with each developing unit 21Y, 21M, 21C and 21K, and forms a latent image to the image carrier of each developing unit 21Y, 21M, 21C and 21K. Each developing unit 21Y, 21M, 21C and 21K develops the latent image with the toner so that the toner image is formed on a surface of the image carrier. Each developing unit 21Y, 21M, 21C and 21K then superposes the toner image of each color one after another on the intermediate belt 24 which is circulated and moved in an arrow direction F2 to enable primary transfer. When the intermediate belt 24 passes through the position of the developing unit 21K which is at downstream end, a color image which is superposing the toner images of four colors is formed on the surface of the intermediate belt 24. The toner image formed on the intermediate belt 24 is in contact with the sheet 9 carried by the paper feeding unit 2 and secondarily transferred on the surface of the sheet 9 when passing through a position faces to the secondary transfer roller 25.

The fixing unit 4 includes a heating roller 4*a* and a pressure roller 4*b*. The fixing unit 4 enables the sheet 9 to which the toner image is transferred to go through between the heating roller 4*a* and the pressure roller 4*b*, and performs a heating operation and a pressure operation on the sheet 9. The fixing unit 4 then fixes the toner image to the sheet 9. The heating roller 4*a* includes a heater 4*c*. Temperature of the heating roller 4*a* rises due to heating of the heater 4*c*. The sheet 9 with the toner image fixed in the fixing unit 4 is then delivered on the paper delivery tray 6 from the delivery port 5 via the carrying path 11.

Figure 2:
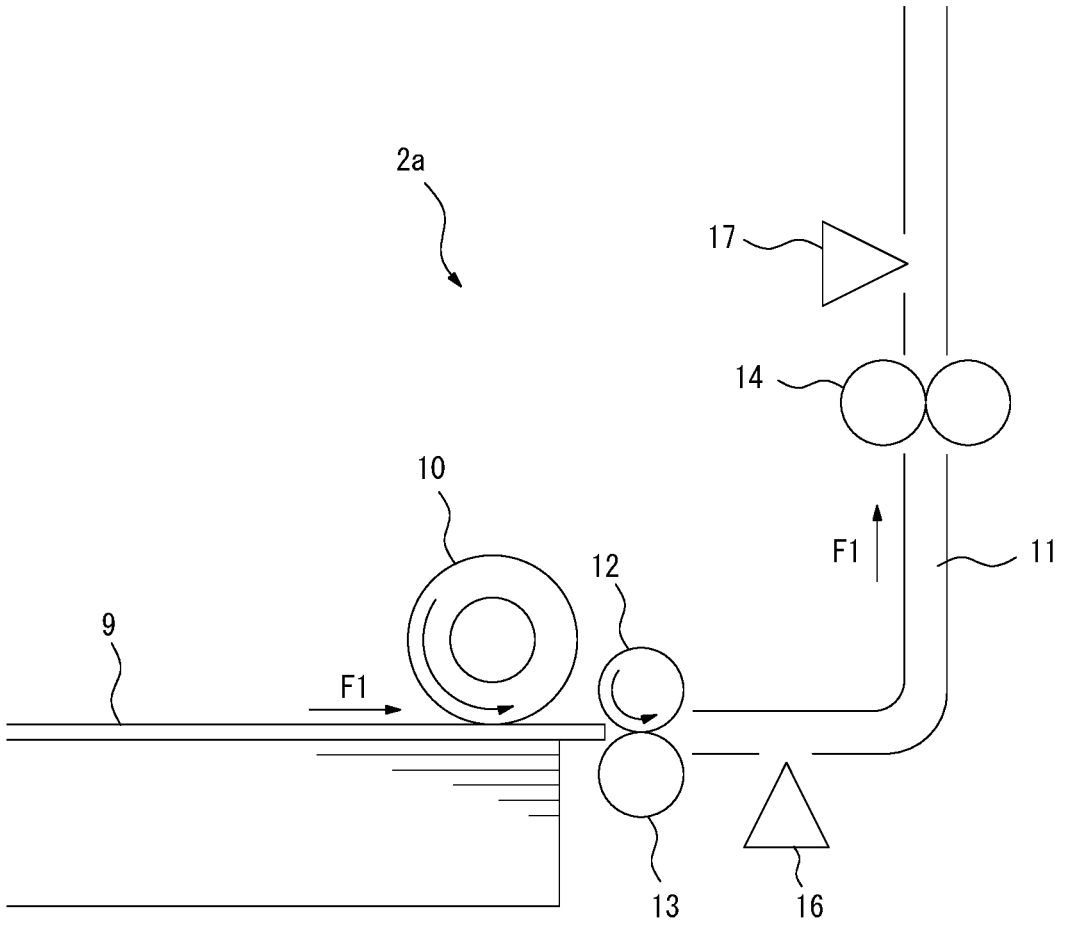
FIG. 2 illustrates an example of an enlarged paper feeding mechanism.

The detail of the paper feeding mechanism 2*a* is explained next. FIG. 2 illustrates an example of the enlarged paper feeding mechanism 2*a*. As illustrated in FIG. 2, the paper feeding mechanism 2*a* includes a pick-up roller 10, a paper feeding roller 12, a separation roller 13, a carrying roller 14, a paper feeding sensor 16 and a paper passing sensor 17 along with the carrying path 11 to carry the sheet 9.

The pick-up roller 10 takes the sheet 9 from a top of the bundle of the sheets 9 stored in the paper feeding tray 8, and feeds out toward the carrying path 11. The pick-up roller 10 is in contact with the sheet 9 which is placed on a top of the bundle of the sheets 9, and is rotated and driven in a direction shown with an arrow of FIG. 2 (counterclockwise direction) by a motor which is not shown in FIG. 2. To be more specific, the pick-up roller 10 is rotated and driven in response to starting the paper feeding operation at the image forming device 1, and feeds out the sheet 9 placed on the top to downstream. When the second sheet 9 following the first sheet 9 placed on the top may also be fed together with the first sheet 9 toward downstream.

The paper feeding roller 12 and the separation roller 13 are arranged in downstream of the pick-up roller 10. The paper feeding roller 12 and the separation roller 13 are a pair related to each other. When more than two sheets 9 are multifed by the pick-up roller 10, the paper feeding roller 12 and the separation roller 13 work in cooperation with each other to only separate the first sheet 9 on the top and feed out the first sheet 9 toward downstream. More specifically, the paper feeding roller 12 is arranged oppositely to the separation roller 13 across the carrying path 11. The paper feeding roller 12 and the separation roller 13 stop feeding out the sheet 9 after the second one of the multiple sheets 9 fed out at the same time from the paper feeding tray 8 by the pick-up roller 10 and only carry the first sheet 9 on the top to downstream.

The paper feeding roller 12 is placed on an upper side of the carrying path 11. The paper feeding roller 12 rotated and driven in a direction shown with an arrow of FIG. 2 (counterclockwise direction) by the motor which is not shown in FIG. 2. The separation roller 13 is placed at a lower side of the carrying path 11. The separation roller 13 is rotated in accordance with the rotation of the paper feeding roller 12. The separation roller 13 is constructed to enable a rotation axis to produce a predetermined frictional force to a bearing. The paper feeding roller 12 rotates the separation roller 13 in accordance with its rotation against the produced frictional force when rotating the separation roller 13 in accordance with its rotation.

When the carrying path 11 receives the sheet 9 fed from the paper feeding roller 12 and the separation roller 13 in a horizontal direction, it carries the sheet 9 in a vertical direction. The carrying roller 14 is provided with the carrying path of the vertical direction. The carrying roller 14 includes a pair of rollers arranged across the carrying path 11. The carrying roller 14 is rotated and driven by a motor which is not shown in FIG. 2 to carry the sheet 9 to an upper direction.

The paper feeding sensor 16 is provided at downstream of the paper feeding roller 12 and the separation roller 13. The paper feeding sensor 16 detects the sheet 9 fed out to downstream of the paper feeding roller 12 at a predetermined position.

The paper passing sensor 17 is provided at further downstream of the paper feeding sensor 16. The paper passing sensor 17 of the first preferred embodiment is provided at a predetermined position which is at downstream of the carrying roller 14 and at an upstream of the aforementioned resist roller 15. The paper passing sensor 17 detects the sheet 9 fed out to downstream by the paper feeding roller 12 and the carrying roller 14 at a predetermined position, as well as the paper feeding sensor 16.

Figure 3A:
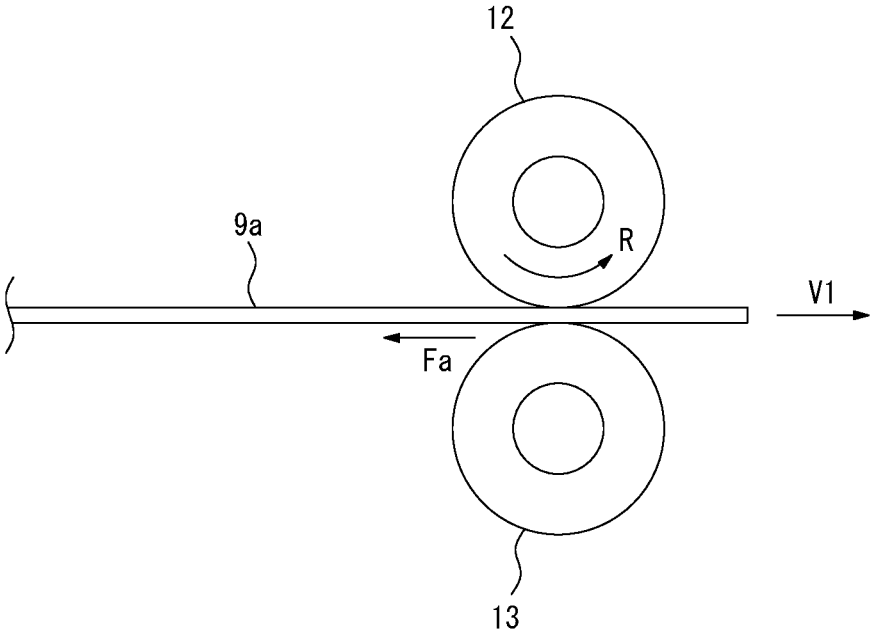
FIGS. 3A and 3B illustrate an example of a sheet fed out to downstream from a paper feeding roller and a separation roller.
Figure 3B:
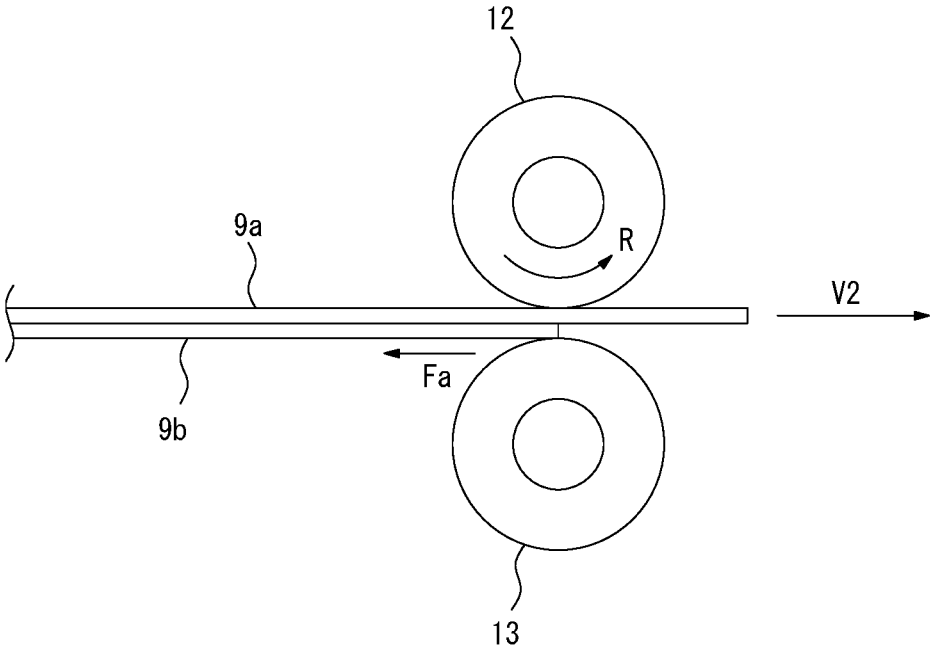

The sheet 9 fed out to downstream from the paper feeding roller 12 and the separation roller 13 is explained next. FIGS. 3A and 3B illustrate an example of the sheet 9 fed out to downstream from the paper feeding roller 12 and the separation roller 13. FIG. 3A illustrates a case where multifeeding does not occur. As illustrated in FIG. 3A, when the single sheet 9 is fed out by the pick-up roller 10, the paper feeding roller 12 and the separation roller 13 pinch the single sheet 9 and feed out to downstream. The paper feeding roller 12 in contact with the upper surface of the sheet 9 rotates in R direction so that applies the carrying force toward downstream to the sheet 9. The paper feeding roller 12 carries the sheet 9 to downstream. The separation roller 13, on the other hand, is in contact with a rear surface of the sheet 9. The separation roller 13 produces a frictional force Fa to the sheet 9. The carrying force by the paper feeding roller 12 is larger than the frictional force Fa produced by the separation roller 13. The separation roller 13, therefore, is rotated in accordance with passage of the sheet 9. A carrying speed of the sheet 9 fed out toward downstream of the paper feeding roller 12 is V1.

FIG. 3B illustrates a case where multifeeding occurs. As illustrated in FIG. 3B, when more than two sheets 9 are multifed by the pick-up roller 10, the paper feeding roller 12 is in contact with the upper surface of the first sheet 9 placed on the top and only feeds out the first sheet 9 to downstream. The rear surface of the sheet 9 after the second one is in contact with the separation roller 13 so that the frictional force Fa from the separation roller 13 is applied to the sheet 9 after the second one and the sheet 9 after the second one is stopped. Only the carrying force from the paper feeding roller 12 is applied to the first sheet 9 and the first sheet 9 is carried to downstream. The first sheet 9 does not affected by the frictional force Fa from the separation roller 13. Although the rear surface of the first sheet 9 is in contact with the upper surface of the second sheet, the frictional force applied from the second sheet 9 to the first sheet 9 is extremely small. By comparing the frictional force applied from the second sheet 9 to the first sheet 9 with the frictional force Fa from the separation roller 13, the frictional force applied from the second sheet 9 to the first sheet 9 is so small that may be ignored. Hence, a carrying speed V2 of the sheet 9 fed out to downstream of the paper feeding roller 12 when the multifeeding occurs becomes higher compared to the carrying speed V1 which is applied when the multifeeding does not occur.

The carrying speed V1 of the sheet 9 fed out to downstream of the paper feeding roller 12 changes depending on whether or not the multifeeding occurs as described above. The controller 7 of the first preferred embodiment detects if the multifeeding occurs at the feeding of the sheet 9, and corrects a measured value for determining wear and the deterioration status of the paper feeding mechanism 2*a* based on the detected result. As a result, the controller 7 is enabled to detect wear and the deterioration of the paper feeding mechanism 2*a* accurately. The controller 7 is explained in detail next.

Figure 4:
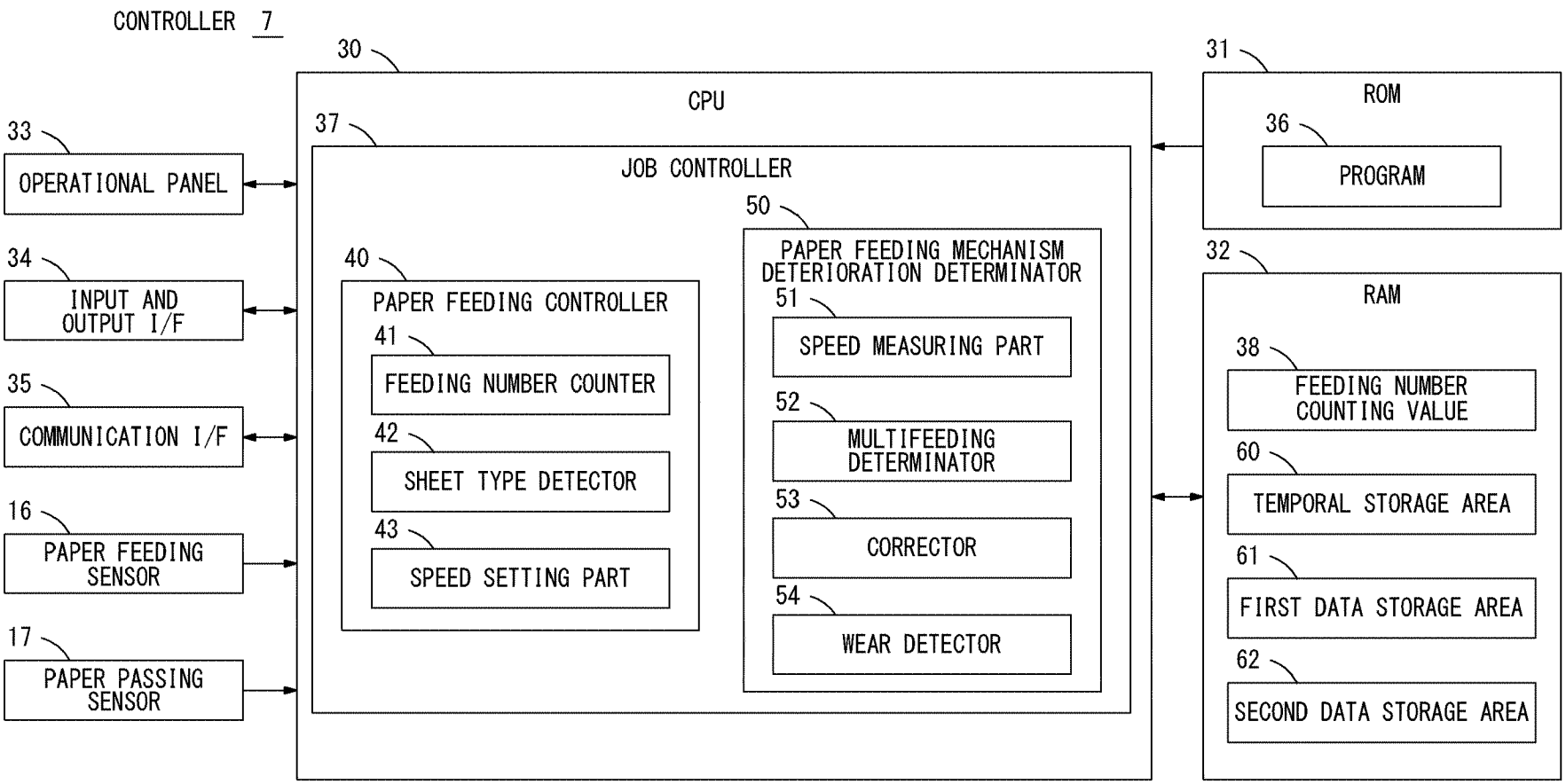
FIG. 4 illustrates a block diagram showing an example of a hardware structure and a functional structure of a controller.

FIG. 4 illustrates a block diagram showing an example of a hardware structure and a functional structure of the controller 7. The controller 7 mainly includes a CPU 30, a ROM 31 and a RAM 32 as illustrated in FIG. 4. The controller 7 is connected to an operational panel 33 by using which a user is enabled to configure a variety of settings. The controller 7 is enabled to configure the variety of settings based on user's operations input via the operational panel 33. Moreover, an input and output interface 34, a communication interface 35, the aforementioned paper feeding sensor 16 and the aforementioned paper passing sensor 17 are connected to the controller 7. The input and output interface 34 is to input and output signals to the respective aforementioned paper feeding unit 2, image forming unit 3 and fixing unit 4, and the communication interface 35 is to communicate with an external device connected over a network such as LAN (Local Area Network).

The CPU 30 is an arithmetic processor that executes a program. The ROM 31 is a non-volatility memory that stores therein a program 36 in advance. The RAM 32 is a rewritable memory, for instance, and is used by the CPU 30 to store temporal data. A feeding number counting value 38, for instance, is stored in the RAM 32. The counted number of the sheets 9 fed by the paper feeding mechanism 2*a* is stored as the feeding number counting value 38. When a part constitutes the paper feeding mechanism 2*a* is replaced to a new one, for example, the feeding number counting value 38 is reset. The RAM 32 includes a temporal storage area 60, a first data storage area 61 and a second data storage area 62. Various types of information besides the aforementioned ones may be stored in the RAM 32.

The CPU 30 reads and executes the program 36 in the ROM 31 so that it serves as a job controller 37. The job controller 37 controls processing of a print job in the image forming device 1. In response to receiving the print job via the communication interface 35, for example, the job controller 37 controls processing of the print job. More specifically, the job controller 37 controls operations of the paper feeding unit 2, the image forming unit 3 and the fixing unit 4 via the input and output interface 34 to produce a printed output based on the received print job. The job controller 37 includes a paper feeding controller 40.

The paper feeding controller 40 controls the operations of the paper feeding mechanism 2*a* in response to processing of the print job so that it enables the sheet 9 stored in the paper feeding tray 8 to be carried to the carrying path 11. To explain in detail, when it is detected by the job controller 37 that it is a paper feeding timing, the paper feeding controller 40 drives the motor that rotates the pick-up roller 10 and the paper feeding roller 12 and supplies the sheet 9 to the carrying path 11 from the paper feeding tray 8. The print job may be a job to continuously form an image on the multiple sheets 9, for example. In this case, the paper feeding controller 40 drives the paper feeding mechanism 2*a* intermittently at predetermined intervals so that the multiple sheets 9 are continuously fed from the paper feeding tray 8. Thus, the image is formed on each of the multiple sheets 9 one after the other. The paper feeding controller 40 as described above includes a feeding number counter 41, a sheet type detector 42 and a speed setting part 43.

The feeding number counter 41 counts the number of sheets fed by the paper feeding mechanism 2*a*. Every time the paper feeding mechanism 2*a* is driven and the single sheet 9 is fed out to the carrying path 11, the feeding number counter 41 adds 1 to a counted value and updates the feeding number counting value 38 in the RAM 32. After a replacement of the part of the paper feeding mechanism 2*a*, the feeding number counter 41 initializes the counted value to 0 and updates the feeding number counting value 38 in the RAM 32. Hence, a total number of the sheets 9 fed by the paper feeding mechanism 2*a* currently mounted is stored as the feeding number counting value 38.

The sheet type detector 42 detects a type of the sheet 9 fed by the paper feeding mechanism 2*a*. After storing the sheet 9 in the paper feeding tray 8, the user operates the operational panel 33 to set the type of the sheet 9, for example. A menu screen for selecting one of multiple types is displayed on the operational panel 33, and the user operates the menu screen to select. The type of the sheet 9 stored in the paper feeding tray 8 is then set. The sheet type detector 42 reads the type of the sheet 9 set by the user, and detects the type of the sheet 9 to feed at start of processing of the print job.

The speed setting part 43 sets the carrying speed (feeding speed) of the sheet 9 applied at the paper feeding mechanism 2*a* at start of processing of the print job. The carrying speed setting part 43 may, for example, set the carrying speed of the sheet 9 applied at the paper feeding mechanism 2*a* constantly at a certain speed no matter what type of the sheet 9 to feed is set. In such a case, however, occurrence of a jam should be prevented even when the type of the sheet 9 is a thick paper, for instance. The speed setting part 43, therefore, sets the carrying speed of the sheet 9 at a relatively low speed in order to feed the thick paper without generation of the jam.

The speed setting part 43 may set the carrying speed corresponding to the type of the sheet 9 detected by the sheet type detector 42. The speed setting part 43 then may set the appropriate carrying speed for the type of the sheet 9 detected by the sheet type detector 42. The type of the sheet 9 may be a thick paper, for example. In this case, the speed setting part 43 set a relatively low carrying speed. The type of the sheet 9 may be a plain paper, for example. In this case, the speed setting part 43 set a relatively high carrying speed. The speed setting part 43 sets the appropriate carrying speed for the type of the sheet 9, enabling to demonstrate maximum throughput at processing of the print job corresponding to the type of the sheet 9.

The paper feeding controller 40 controls the operation of the paper feeding mechanism 2*a* to enable the sheet 9 to be carried at the carrying speed set by the speed setting part 43 when processing of the print job is started. It is assumed, for instance, the image forming device 1 is provided with the multiple paper feeding trays 8 and a different type of the sheet 9 is stored in each paper feeding tray 8. In this case, the type of the sheet 9 may be changed during processing of the print job. The speed setting part 43 then may switch the carrying speed of the sheet 9 in response to the change made in the type of the sheet 9 during processing of the print job.

The job controller 37 includes a paper feeding mechanism deterioration determinator 50. The paper feeding mechanism deterioration determinator 50 determines a wear and deterioration status of the paper feeding mechanism 2*a*. The paper feeding mechanism deterioration determinator 50 measures the carrying speed of the sheet 9 and determines wear and the deterioration status of the paper feeding mechanism 2*a* based on the carrying speed every time the sheet 9 is fed by the paper feeding mechanism 2*a*. More specifically, the operation to feed the sheet 9 performed repeatedly wears and deteriorates the pick-up roller 10, the paper feeding roller 12 and the separation roller 13 gradually. When the paper feeding mechanism 2*a* is more worn and deteriorated, the carrying speed of the sheet 9 fed by the paper feeding mechanism 2*a* is reduced gradually. The paper feeding mechanism deterioration determinator 50 measures the carrying speed of the sheet 9 fed out to downstream from the paper feeding roller 12 and determines wear and the deterioration status of the paper feeding mechanism 2*a* based on whether or not how much the carrying speed of the sheet 9 has reduced. The paper feeding mechanism deterioration determinator 50 includes a speed measuring part 51, a multifeeding determinator 52, a corrector 53 and a wear detector 54.

The speed measuring part 51 measures the carrying speed of the sheet 9 when the sheet 9 is fed by the paper feeding mechanism 2*a*. The carrying speed of the sheet 9, for example, is correlated with the time required for the sheet 9 to move a distance between two points arranged along the carrying path 11. The speed measuring part 51 of the first preferred embodiment is configured to measure a time (passing time) required for the sheet 9 to move between the two points on the carrying path 11 for convenience. To be more specific, the speed measuring part 51 measures the passing time from detection by the paper feeding sensor 16 of the leading end of the sheet 9 fed out to downstream of the carrying path by the paper feeding roller 12 to the detection by the paper passing sensor 17 after feeding by the paper feeding mechanism 2*a* is started. The distance between the position of the paper feeding sensor 16 and the position of the paper passing sensor 17 on the carrying path 11 has already been known, and does not change. Thus, the measurement of the passing time required for the sheet 9 to move the distance is equivalent to the measurement of the carrying speed of the sheet 9. In the first preferred embodiment, the passing time of the sheet 9 is measured instead of the carrying speed of the sheet 9.

The carrying speed of the sheet 9 fed out to downstream from the paper feeding roller 12 when the multifeeding occurs due to the pick-up roller 10 as described above is higher than the carrying speed when the multifeeding does not occur. If the multifeeding occurs even when the paper feeding mechanism 2*a* is worn and deteriorated, the carrying speed will be the carrying speed nearly equal to a normal value. To be more specific, when the multifeeding occurs due to the pick-up roller 10, the passing time measured by the speed measuring part 51 is less compared to the passing time measured when the multifeeding does not occur. As a result, wear and the deterioration status of the paper feeding mechanism 2*a* cannot be detected accurately.

The speed measuring part 51 includes the multifeeding determinator 52 and the corrector 53. The multifeeding determinator 52 and the corrector 53 determine whether or not the multifeeding occurs when the passing time required for the sheet 9 to move from the position of the paper feeding sensor 16 to the position of the paper passing sensor 17 is measured by the speed measuring part 51. When determining that the multifeeding occurs, the multifeeding determinator 52 and the corrector 53 correct the passing time to a value equivalent to a value measured if the multifeeding does not occur.

The multifeeding determinator 52 determines whether or not the multifeeding of the sheets 9 occurs. In order to determine whether or not the sheets 9 fed by the pick-up roller 10 are multifed, the multifeeding determinator 52 measures a time (determining time) from a timing that feeding of the next sheet 9 is started to a timing that the leading end of the next sheet 9 is detected by the paper feeding sensor 16. The multifeeding determinator 52 determines whether or not the multifeeding of the previous sheets 9 occurs based on the determining time measured from a time to start feeding the paper to a timing that the paper feeding sensor 16 detects the leading end of the next sheet 9.

The multifeeding may not occur due to the pick-up roller 10. In this case, the following sheet 9 fed out from the paper feeding tray 8 next is not proceeded to the position of the separation roller 13 and is remain at the position of the bundle of the sheets 9 stored in the paper feeding tray 8. When the following sheet 9 is started to be fed, the following sheet 9 proceeds to the position where the paper feeding roller 12 and the separation roller 13 are arranged. The following sheet 9 then proceeds to the position where the paper feeding sensor 16 is arranged which is at downstream of the paper feeding roller 12. Thus, when the multifeeding due to the pick-up roller 10 does not occur, a certain time is required until the leading end of the following sheet 9 is detected by the paper feeding sensor 16 after feeding of the following sheet 9 is started.

On the other hand, when the multifeeding occurs due to the pick-up roller 10, the leading end of the following second sheet 9 to be fed has already reached to the position in contact with the separation roller 13. If the feeding of the following sheet 9 is started from this point, the following sheet 9 is started to proceed to downstream from the position where the paper feeding roller 12 and the separation roller 13 are arranged and reaches to the position where the paper feeding sensor 16 is arranged in a relatively short time. When the multifeeding occurs due to the pick-up roller 10, the determining time until the paper feeding sensor 16 detects the leading end of the following sheet 9 after feeding of the following sheet 9 is started is less than the value measured if the multifeeding does not occur.

The determining time until the paper feeding sensor 16 detects the leading end of the following sheet 9 after start of feeding the following sheet 9 may be equal to or more than a predetermined period of time (200 ms, for instance). In such a case, the multifeeding determinator 52 determines that the multifeeding does not occur at feeding of the previous sheet 9. The determining time until the paper feeding sensor 16 detects the leading end of the following sheet 9 after start of feeding the next sheet 9 may be below the predetermined period of time. In such a case, the multifeeding determinator 52 determines that the multifeeding occurs at feeding of the previous sheet 9 and the passing time measured at feeding of the previous sheet 9 is affected by the multifeeding.

As described above, the multifeeding determinator 52 determines whether or not multifeeding occurs at feeding of the previous sheet 9 when the following sheet 9 is to be fed after the previous sheet 9 is fed. To be in detail, the measurement of the passing time of the sheet 9 by the speed measuring part 51 does not enable the determination whether or not correction is necessary until feeding of the following sheet 9 is carried out. Once measuring the passing time of the sheet 9, the speed measuring part 51 stores the measured value in the temporal storage area 60 of the RAM 32.

Figure 5:
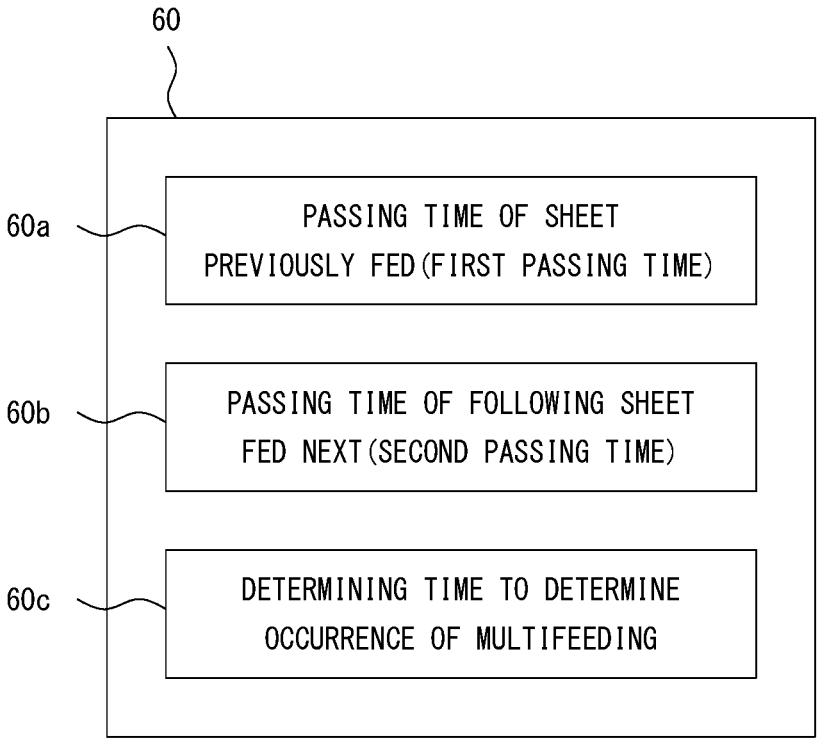
FIG. 5 illustrates an exemplary structure of a temporal storage area.

FIG. 5 illustrates an exemplary structure of the temporal storage area 60. The temporal storage area 60 includes storage areas 60*a* to 60*c*. The storage area 60*a* is to store the passing time (a first passing time) of the sheet 9 previously fed. The storage area 60*b* is to store the passing time (a second passing time) of the following sheet 9 fed next, and the storage area 60*c* is to store the determining time measured at feeding of the following sheet 9. The speed measuring part 51, for example, temporarily stores the passing time measured at feeding of the previous sheet 9 in the storage area 60*a*, and temporarily stores the passing time measured at feeding of the following sheet 9 in the storage area 60*b*. The multifeeding determinator 52 temporarily stores the determining time measured at feeding of the following sheet 9 in the storage area 60*c*. The multifeeding determinator 52 then determines if the multifeeding has occurred at feeding of the previous sheet 9 based on the determining time stored in the storage area 60*c*.

When determining multifeeding has occurred at feeding of the previous sheet 9, the multifeeding determinator 52 determines if a correction coefficient C has already been calculated. The correction coefficient C is used to correct the passing time measured under occurrence of the multifeeding to the passing time measured under no occurrence of the multifeeding. When the correction coefficient C has not been calculated yet, the multifeeding determinator 52 moves data of the passing time of the previous sheet 9 in the temporal storage area 60 to the first data storage area 61. Once the number of the data of the passing time stored in the first data storage area 61 exceeds a predetermined number, the multifeeding determinator 52 brings the corrector 53 to be in operation to calculate the correction coefficient C. On the other hand, the correction coefficient C may have already been calculated. In such a case, the multifeeding determinator 52 brings the corrector 53 to be in operation to correct the passing time of the previous sheet 9 based on the correction coefficient C.

When determining that the multifeeding at feeding of the previous sheet 9 does not occur, the multifeeding determinator 52 moves the data of the passing time of the previous sheet 9 in the temporal storage area 60 to the second data storage area 62. This time, the corrector 53 is not put into operation. As a result, the data of the passing time measured under no occurrence of the multifeeding is accumulated in the second data storage area 62.

Next, the corrector 53 is explained. The corrector 53 calculates the correction coefficient C when the number of the data in the first data storage area 61 exceeds the predetermined number if the correction coefficient C has not been calculated yet. The corrector 53, for example, calculates an average A of the predetermined number of the data (passing time) stored in the first data storage area 61, also calculating an average B of the data (passing time) in the second data storage area 62 stored at the point of this calculation. The corrector 53 divides the average B by the average A so that calculating the correction coefficient C (=B/A). As described above, the correction coefficient C is calculated using the average A of the data (corresponding to multiple numbers of passing times) measured when the multifeeding occurs and the average B of the data (corresponding to multiple numbers of passing times) measured if the multifeeding does not occur so that variations between the correction coefficient C are controlled.

It may be determined that the multifeeding at feeding of the previous sheet 9 occurs when the correction coefficient C has already been calculated. In this case, the corrector 53 reads the passing time corresponding to the previous sheet 9 in the temporal storage area 60, and multiplies the passing time by the correction coefficient C. The passing time measured if the multifeeding occurs is corrected to the passing time if the multifeeding does not occur. The corrector 53 then stores the corrected passing time in the second data storage area 62. Thus, the data corresponding to the passing time corrected by the corrector 53 is accumulated in the second data storage area 62.

The corrector 53 discards the correction coefficient C if the number of the papers fed by the paper feeding mechanism 2*a* has exceeded a predetermined number after calculating the correction coefficient C. The corrector 53 then newly calculates the correction coefficient C. As described above, the corrector 53 calculates again the correction coefficient C every time the number of the fed papers has exceeded the predetermined number so that the correction coefficient C is enabled to be updated to a value describing the status of the image forming device 1 in a constant period.

The wear detector 54 detects wear and the deterioration status of the paper feeding mechanism 2*a* based on the passing time measured by the speed measuring part 51 or the passing time corrected by the corrector 53. To be more specific, every time the number of the data (corresponding to the predetermined number of passing times) stored in the second data storage area 62 reaches the predetermined number, the wear detector 54 detects the current wear and deterioration status of the paper feeding mechanism 2*a* and determines if a replacement time of the part is near. When the replacement time of the part is near, the wear detector 54 notifies the user of the replacement time of the part. The wear detector 54 displays information relating to the replacement time of the part on the operational panel 33 to notify the user. The wear detector 54 may notify an external server of the replacement time via the communication interface 35.

After determining wear and the deterioration status of the paper feeding mechanism 2*a* based on the data in the second data storage area 62, the wear detector 54 may discard the data in the second data storage area 62. If the data in the second data storage area 62 is discarded, it is not necessary for the wear detector 54 to refer to the old data at next determination, resulting in efficient determination. Moreover, wear and the deterioration status of the paper feeding mechanism 2*a* at the determination may be accurately detected.

A process sequence performed by the controller 7 to determine wear and the deterioration status of the paper feeding mechanism 2*a* is explained next. FIGS. 6 to 11 illustrate flow diagrams explaining exemplary procedures of the process performed by the controller 7. This process is performed when the CPU 30 of the controller 7 executes the program 36. The process is repeatedly performed by the controller 7 on a constant interval.

Figure 6:
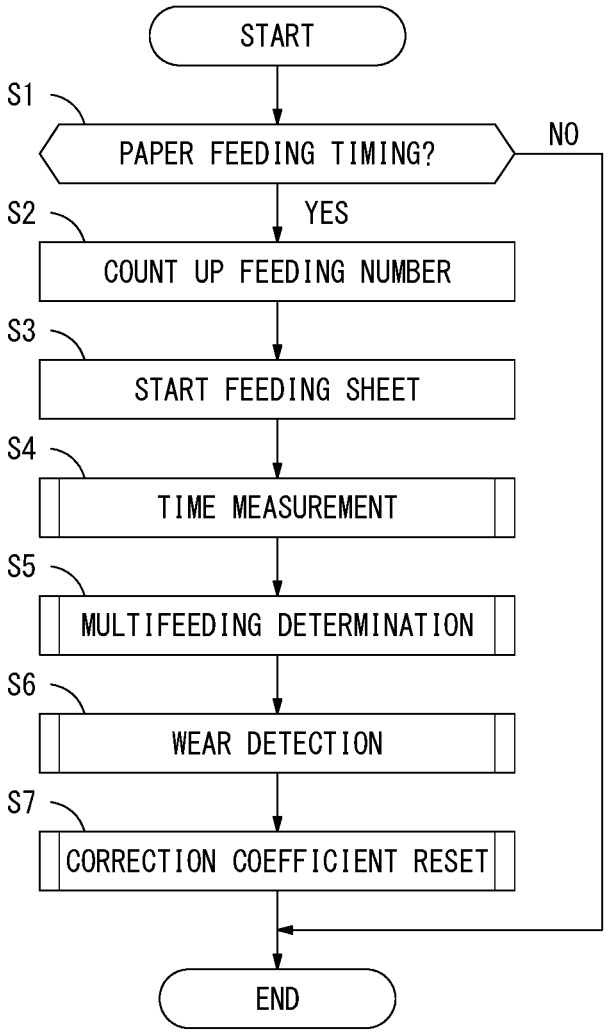
FIG. 6 illustrates a flow diagram explaining an exemplary procedure of a process performed by the controller.

Upon start of the process based on the flow diagram of FIG. 6, the controller 7 determines if it is a paper feeding timing that the paper feeding mechanism 2*a* feeds the paper (step S1). If it is not the paper feeding timing (when a result of step S1 is NO), the process by the controller 7 completes. When it is the paper feeding timing (when a result of step S1 is YES), the controller 7 counts up the feeding number counting value 38 (step S2), and drives the paper feeding mechanism 2*a* to start feeding the sheet 9 (step S3). The controller 7 detects the type of the sheet 9 and sets the carrying speed corresponding to the detected type of the sheet 9. After starting feeding the sheet 9, the controller 7 starts a time measurement (step S4).

Figure 7:
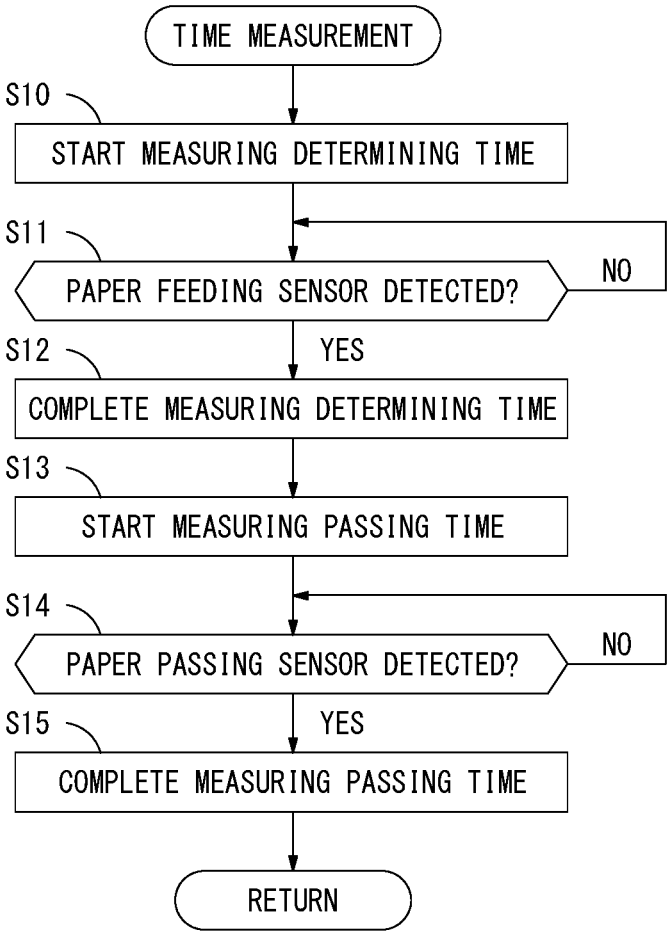
FIG. 7 illustrates a flow diagram explaining an exemplary procedure of a time measurement in detail.

FIG. 7 illustrates a flow diagram explaining an exemplary procedure of the time measurement (step S4) in detail. After starting the time measurement, the controller 7 starts measuring the determining time for determining if the multifeeding has occurred at feeding of the previous sheet 9 (step S10). More specifically, the measurement of the determining time is started at the same time as the operation of feeding the sheet by the paper feeding mechanism 2*a* is started. The controller 7 waits until the paper feeding sensor 16 detects the leading end of the sheet 9 (step S11). Once the paper feeding sensor 16 detects the leading end of the sheet 9, the controller 7 completes the measurement of the determining time and stores the measured determining time in the temporal storage area 60 (step S12).

After the paper feeding sensor 16 detects the leading end of the sheet 9, the controller 7 starts measuring the passing time (step S13). The controller 7 then waits until the paper passing sensor 17 detects the leading end of the sheet 9 (step S14). When the paper passing sensor 17 detects the leading end of the sheet 9, the controller 7 completes the measurement of the passing time and stores the measured passing time in the temporal storage area 60 (step S15). As described above, the time measurement is complete.

Referring back to the flow diagram of FIG. 6, the controller 7 performs a multifeeding determination (step S5) after the time measurement.

Figure 8:
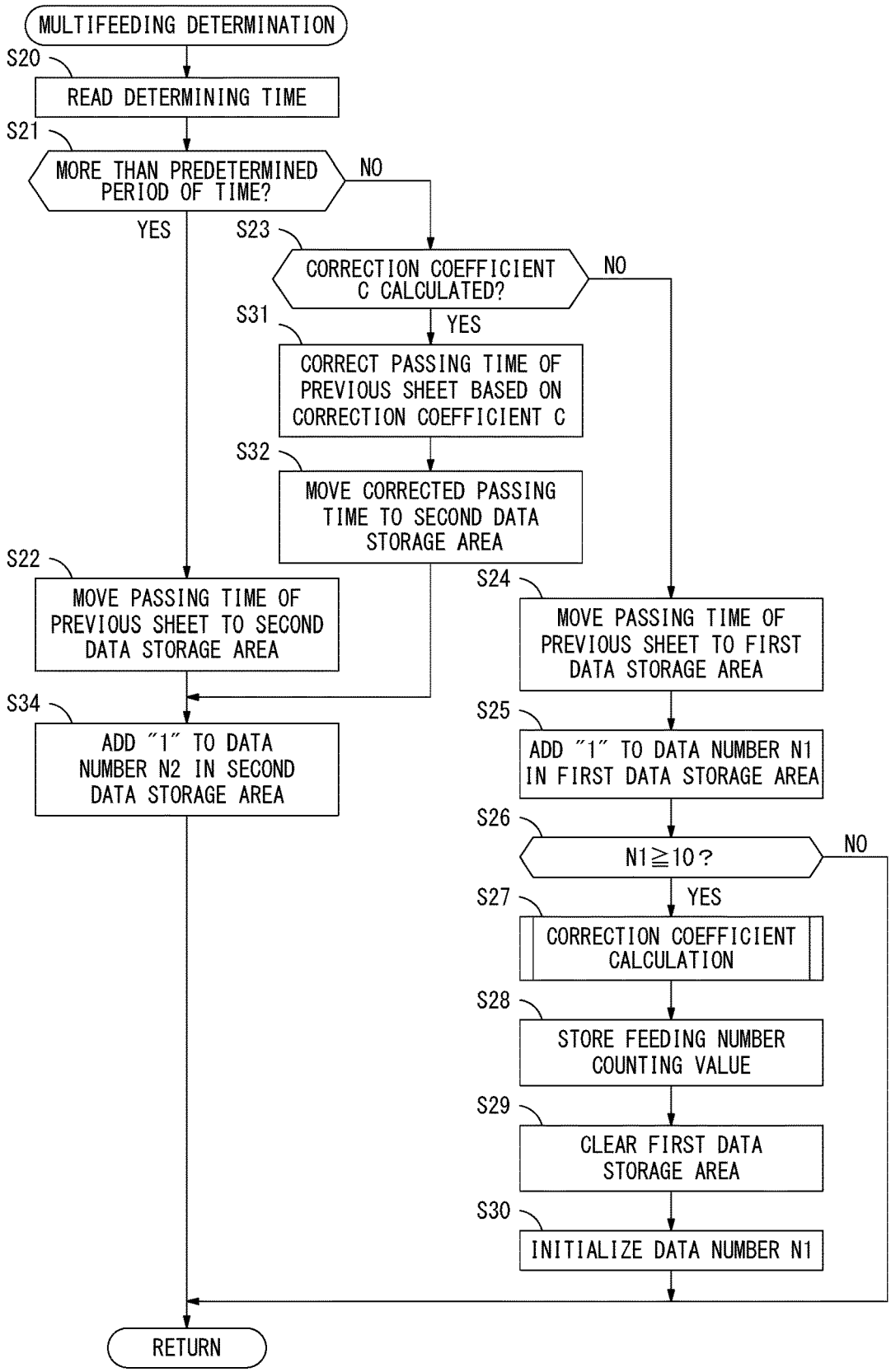
FIG. 8 illustrates a flow diagram explaining an exemplary procedure of a multifeeding determination in detail.

FIG. 8 illustrates a flow diagram explaining an exemplary procedure of the multifeeding determination (step S5) in detail. After starting the multifeeding determination, the controller 7 reads the determining time in the temporal storage area 60 (step S20). The controller 7 determines if the determining time is equal to or more than the predetermined period of time (step S21). When the determining time is equal to or more than the predetermined period of time (when a result of step S21 is YES), it means the multifeeding does not occur at feeding of the previous sheet 9. The controller 7 then moves the data corresponding to the passing time of the previous sheet 9 in the temporal storage area 60 to the second data storage area 62 (step S22).

When the determining time is less than the predetermined period of time (when a result of step S21 is NO), it means the multifeeding occurs at feeding of the previous sheet 9. The controller 7 then determines if the correction coefficient C has already been calculated (step S23). If the correction coefficient C has not been calculated yet (when a result of step S23 is NO), the controller 7 moves the data corresponding to the passing time of the previous sheet 9 in the temporal storage area 60 to the first data storage area 61 (step S24), and adds 1 to a value of the number of the data N1 in the first data storage area 61 (step S25).

The controller 7 determines whether or not the number of the data N1 in the first data storage area 61 is equal to or more than a predetermined number (for instance, 10) (step S26). When the number of the data N1 is less than the predetermined number (when a result of step S26 is NO), the number of the data does not satisfy the required number of data for calculation of the correction coefficient C, and the controller 7 completes the multifeeding determination. When the number of the data N1 is equal to or more than the predetermined number (when a result of step S26 is YES), the number of the data completes the required number of data for calculation of the correction coefficient C, and the controller 7 performs a correction coefficient calculation (step S27).

Figure 9:
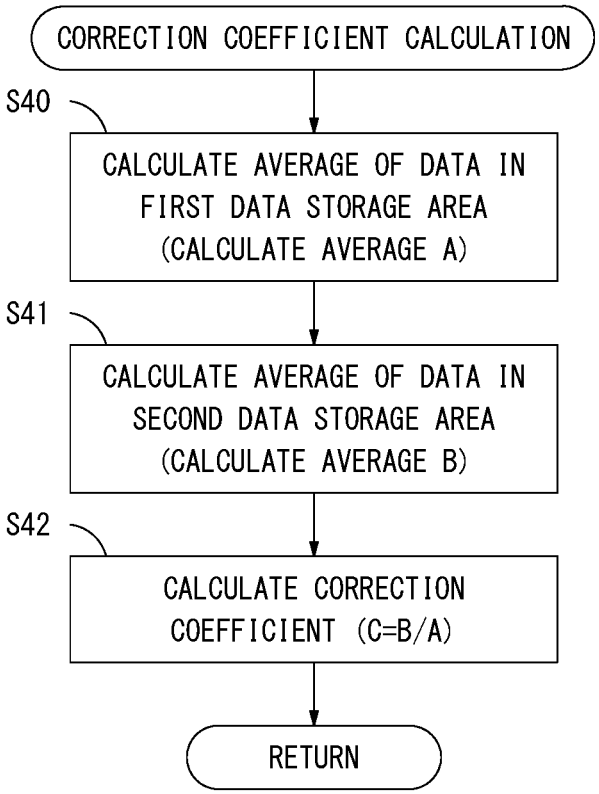
FIG. 9 illustrates a flow diagram explaining an exemplary procedure of a correction coefficient calculation in detail.

FIG. 9 illustrates a flow diagram explaining an exemplary procedure of the correction coefficient calculation (step S27) in detail. After starting the correction coefficient calculation, the controller 7 reads a whole of the predetermined number of the data (passing time) in the first data storage area 61, and calculates the average A of the predetermined number of the data (step S40). The average A shows an average of the passing time measured under occurrence of the multifeeding. The controller 7 reads a whole of the data (passing time) stored in the second data storage area 62 at the time, and calculates the average B of the data (step S41). The average B shows an average of the passing time measured under no occurrence of the multifeeding. For calculation of the average B, if the corrected data (passing time) is included in the data stored in the second data storage area 62, the controller 7 may exclude the corrected data and use the data (passing time) actually measured by the speed measuring part 51 to calculate the average B. The controller 7 then calculates the correction coefficient C based on the two averages A and B (step S42). Thus, the correction coefficient calculation is complete.

Referring back to the flow diagram of FIG. 8, after calculating the correction coefficient C, the controller 7 reads the current feeding number counting value 38. The controller 7 then stores the read counting value and the correction coefficient C corresponding to the counting value in the RAM 32 (step S28). FIG. 12 illustrates an example of the information stored in the RAM 32. The controller 7 manages the correction coefficient C calculated in step S27 and the corresponding feeding number counting value which is obtained at calculation of the correction coefficient. The correction coefficient C and the feeding number counting value corresponding to each other are stored. In the example of FIG. 12, the correction coefficient C is "1.067" and the feeding number counting value is "10,003 sheets."

The controller 7 then clears the first data storage area 61 (step S29). To be more specific, the controller 7 discards a whole data (passing time) stored in the first data storage area 61. The controller 7 also initializes the number of the data N1 in the first data storage area 61 to 0, and completes the multifeeding determination. As described above, when the correction coefficient C has not been calculated yet and the predetermined number (10, for instance) of the data is stored in the first data storage area 61, the correction coefficient C is calculated using the predetermined number of the data.

When the correction coefficient C has already been calculated in step S23 (when a result of step S23 is YES), the controller 7 reads the correction coefficient C in the RAM 32 and the passing time of the previous sheet 9 in the temporal storage area 60. The controller 7 corrects the passing time of the previous sheet 9 based on the correction coefficient C (step S31). As a result, the controller 7 is enabled to correct the passing time of the previous sheet 9 measured by the speed measuring part 51 to the passing time equivalent to the value measured under no occurrence of the multifeeding at feeding of the sheet 9. The controller 7 then stores the corrected passing time in the second data storage area 62 (step S32).

After storing the passing time of the previous sheet 9 in the second data storage area 62 in step S22 or S32, the controller 7 adds 1 to the value of the number of data N2 stored in the second data storage area 62 and updates the number of data N2 (step S34). As described above, the multifeeding determination is complete.

Referring back to the flow diagram of FIG. 6, after the multifeeding determination, the controller 7 performs the wear detection (step S6).

Figure 10:
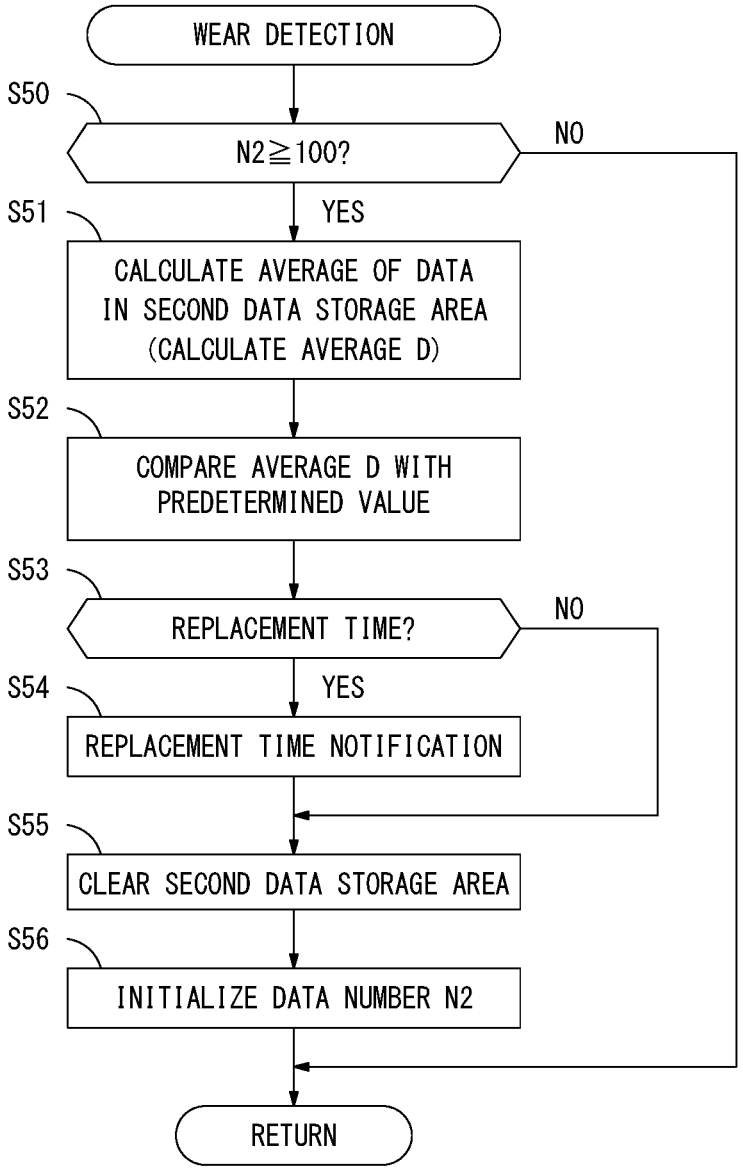
FIG. 10 illustrates a flow diagram explaining an exemplary procedure of a wear detection in detail.

FIG. 10 illustrates a flow diagram explaining an exemplary procedure of the wear detection (step S6) in detail. After starting the process, the controller 7 determines if the number of data N2 stored in the second data storage area 62 reaches a predetermined number (100 in the example of FIG. 10) (step S50). When the number of data N2 is less than the predetermined number (when a result of step S50 is NO), the controller 7 completes the wear detection since the number of data does not satisfy the necessary number for determination of wear and the deterioration status. When the number of data N2 is equal to or more than the predetermined number (when a result of step S50 is YES), the controller 7 starts the process to determine the wear and deterioration status.

The controller 7 reads the whole predetermined number of data (corresponding to the predetermined number of passing times) in the second data storage area 62, and calculates an average D of the passing times (step S51). For calculation of the average D, even if the corrected data (passing time) is included in the data stored in the second data storage area 62, the controller 7 calculates the average D based on the whole data including the corrected data. The average D shows an average of the passing times required for the sheet 9 to move to the position of the paper passing sensor 17 from the position of the paper feeding sensor 16. The average D is the average of the passing times not affected by the multifeeding.

Once calculating the average D, the controller 7 compares the average D with a predetermined value (step S52), and determines if it is the replacement time of the part of the paper feeding mechanism 2*a* (step S53). Increase in the number of sheets fed by the paper feeding mechanism 2*a* proceeds wear and the deterioration, and the replacement time will come eventually. The controller 7 determines the replacement time based on the average D of the passing times.

Figure 13:
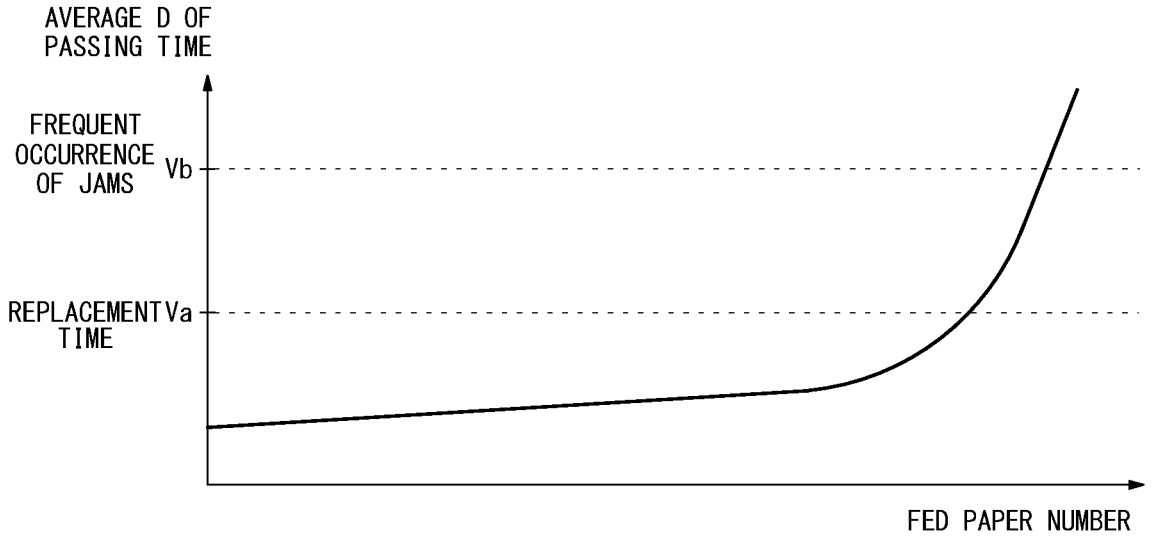
FIG. 13 illustrates an example of a relation between the number of fed papers and an average of passing times.

FIG. 13 illustrates an example of a relation between the number of fed papers and the average D of the passing times. Increase in the number of the fed papers increases the average D of the passing times as illustrated in FIG. 13. Once the average D of the passing times exceeds a predetermined value Va, the replacement time of the part of the paper feeding mechanism 2*a* comes. Moreover, if the average D exceeds a predetermined value Vb, there will be more jams occur in the image forming device 1. The predetermined value Va showing the replacement time of the part is set at a smaller value than the predetermined value Vb showing frequent occurrences of jams. The replacement time of the part may be detected before the jam frequently occurs in the image forming device 1. The controller 7 compares the average D with the predetermined value Va and determines if it is the replacement time of the part of the paper feeding mechanism 2*a*.

When determining it is the replacement time of the part of the paper feeding mechanism 2*a* (when a result of step S53 is YES), the controller 7 performs a replacement time notification (step S54). The controller 7, for example, displays information notifying the replacement time of the part of the paper feeding mechanism 2*a* on the operational panel 33 to notify the user of the replacement time. Alternatively, the controller 7 may notify the external device such as the external server of the replacement time of the part via the communication interface 35. The external server may be the server belong to an organization that operates maintenances of the image forming device 1. In this case, the server is enabled to notify a worker of the appropriate maintenance time. The part of the image forming device 1 may be replaced before the jams frequently occur. When determining it is not the replacement time of the part (when a result of step S53 is NO), the controller 7 does not perform the process in step S54.

After determining whether or not it is the replacement time of the part in the current determination timing, the controller 7 clears the second data storage area 62 and discards the whole data stored in the second data storage area 62 (step S55). The controller 7 then initializes the number of data N2 in the second data storage area 62 to 0 (step S56). As a result, the next deterioration detection is performed when the predetermined number (for instance, 100) of data is again stored in the second data storage area 62. As described above, the deterioration detection is complete.

Referring again back to the flow diagram of FIG. 6, after the wear detection process, the controller 7 performs a correction coefficient reset (step S7). Increase in the number of sheets fed by the paper feeding mechanism 2*a* proceeds wear and the deterioration, resulting in gradual decrease in accuracy of the correction coefficient C. The controller 7 performs the correction coefficient reset on a periodical basis in order to reset the correction coefficient C.

Figure 11:
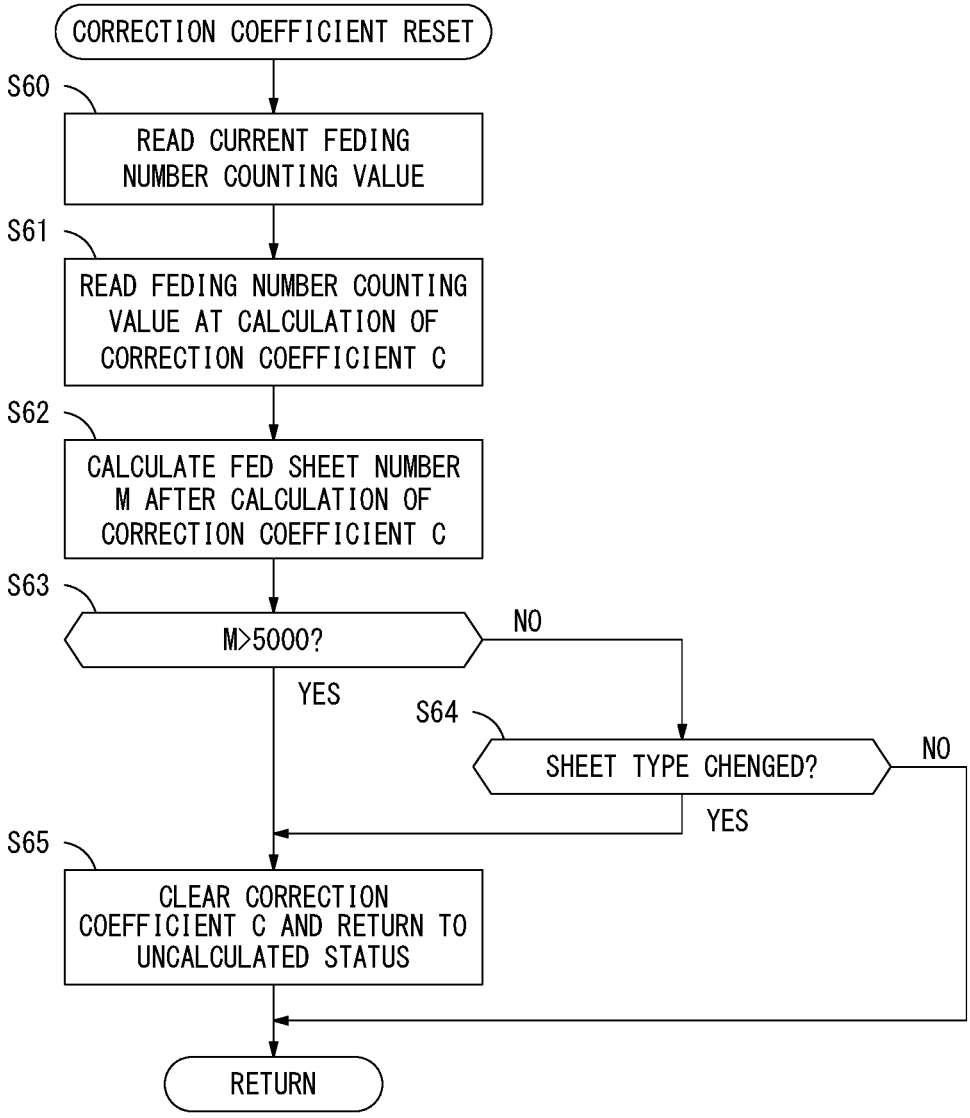
FIG. 11 illustrates a flow diagram explaining an exemplary procedure of a correction coefficient reset in detail.

FIG. 11 illustrates a flow diagram explaining an exemplary procedure of the correction coefficient reset (step S7) in detail. After starting the process, the controller 7 reads the current feeding number counting value 38 (step S60). The controller 7 then reads the feeding number counting value corresponding to the calculated correction coefficient C which is stored in the RAM 32 and managed together with the correction coefficient C (step S61). The controller 7 calculates, based on the two values read in steps S60 and S61, the number M of fed sheets 9 fed up to present after the correction coefficient C is calculated (step S62).

After calculating the number of fed sheets M after calculation of the correction coefficient C, the controller 7 determines whether or not the number of fed sheets M exceeds a predetermined number (5000 sheets in the example of FIG. 11) (step S63). When the number of fed sheets M does not exceed the predetermined number (when a result of step S63 is NO), the controller 7 determines if the type of the sheet 9 has been changed (step S64). The change in the type of the sheet 9 may make a change in the carrying speed of the sheet 9. Whether or not change is made in the type of the sheet 9 is, therefore, determined as one of conditions to reset the correction coefficient C. To be more specific, the controller 7 determines if it is a time to reset the correction coefficient C in steps S63 and S64. If it is the time to reset the correction coefficient C (when a result of step S63 is YES or a result of step S64 is YES), the controller 7 clears the current correction coefficient C and puts back to the status where the correction coefficient C has not been calculated yet (step S65). As a result, the process to calculate the correction coefficient C is then performed again in the above-described multifeeding determination (step S5 in FIG. 8).

If it is not the time to reset the correction coefficient C (when a result of step S63 is NO and a result of step S64 is NO), the controller 7 completes the correction coefficient reset without clearing the correction coefficient C. When the correction coefficient C has not been calculated at the start of the process, the reset is not necessary. Thus, the correction coefficient reset is complete.

The above-described correction coefficient reset is performed so that the correction coefficient C is reset on a periodical basis. The correction coefficient C may be updated to the appropriate value in response to the progress of wear and the deterioration status of the paper feeding mechanism 2*a*. The passing time measured under occurrence of the multifeeding in the process of the deterioration of the paper feeding mechanism 2*a* may be corrected appropriately.

The image forming device 1 of the first preferred embodiment includes the speed measuring part 51, the multifeeding determinator 52, the corrector 53 and the wear detector 54. The speed measuring part 51 measures the passing time of the sheet 9 fed by the paper feeding mechanism 2*a*, and the multifeeding determinator 52 determines if the passing time measured by the speed measuring part 51 is affected by the following sheet 9 to be fed next. The corrector 53 corrects the passing time when the multifeeding determinator 52 determines the passing time is affected by the following sheet 9 to be fed next, and the wear detector 54 detects the wear status on the paper feeding mechanism 2*a* based on the passing time measured by the speed measuring part 51 or the passing time corrected by the corrector 53. This structure enables the correction of the passing time based on whether or not the multifeeding occurs at feeding of the sheet 9. If the measured passing time is affected by the multifeeding, the passing time may be converted into the passing time not affected by the multifeeding and the wear status on the paper feeding mechanism 2*a* may be detected based on the converted passing time. The image forming device 1 of the first preferred embodiment is enabled to determine wear and the deterioration of the paper feeding mechanism 2*a* more accurately than a conventional way.

In response to detecting the change made in the type of the sheet 9, the correction coefficient C is reset as described above. However, this is given not for limitation. The controller 7 may store the multiple correction coefficients C corresponding to the respective types of the sheets 9. FIG. 14 illustrates an example of information relating to each correction coefficient C stored in the RAM 32 in the aforementioned case. The controller 7 calculates the correction coefficient C corresponding to the type every time the change in the type of the sheet 9 is detected by the sheet type detector 42. The controller 7 then stores the type of the sheet 9, the correction coefficient C and the feeding number counting value obtained at the calculation of the correction coefficient C corresponding to each other in the RAM 32 and manages as illustrated in FIG. 14. In the example of FIG. 14, the correction coefficients C may be registered for three types of the sheets 9 including a plain paper, a thick paper 1 and a thick paper 2, respectively.

When the correction coefficient C corresponding to the changed type of the sheet 9 has already been calculated when the change is made in the type of the sheet 9, the controller 7 reads the correction coefficient C corresponding to the sheet 9 in the information of FIG. 14, and corrects the passing time measured under occurrence of the multifeeding. The controller 7 determines if the number of the fed sheets after the correction coefficient C is calculated exceeds a predetermined number (for instance, 5000 sheets) based on the feeding number counting value obtained at the calculation of the correction coefficient C. When the number of fed sheets exceeds the predetermined number, the controller 7 resets the correction coefficient C. In other words, if the correction coefficient C corresponding to the type of the sheet 9 has already been calculated and the number of the fed papers after calculation of the correction coefficient C is less than the predetermined number (for instance, 5000) when the change made in the type of the sheet 9 is detected, the controller 7 corrects the passing time using the correction coefficient C which has been used until then. The correction coefficient C is stored corresponding to each type of the sheet 9. If the correction coefficient C corresponding to the changed type has already been calculated when the change in the type of the sheet 9 is detected, it is not necessary to calculate the correction coefficient C again, resulting in improved process efficiency.

In the example described above, 10 pieces of data are stored as an example of storing the predetermined number of data in the first data storage area 61 to calculate the correction coefficient C. The number of the data to calculate the correction coefficient C does not always have to be 10 pieces. The number of the data may be more than 11 or less than 9. Increase in the number of data to calculate the correction coefficient C may control to have small variations between the circulated correction coefficient C but at the same time, the time for collecting the data to calculate the correction coefficient C is required. The time is required until determining wear and the deterioration of the paper feeding mechanism 2*a*. Decrease in the number of data to calculate the correction coefficient C enables to start the determination of wear and the deterioration of the paper feeding mechanism 2*a* at an early stage but at the same time, it has bigger variations between the calculated correction coefficient C.

In the example described above, after calculation of the correction coefficient C using the predetermined number of data stored in the first data storage area 61, the first data storage area 61 is cleared and the data in the first data storage area 61 is discarded. However, this is given not for limitation. After calculation of the correction coefficient C, the passing time stored in the first data storage area 61 may be corrected using the correction coefficient C and the corrected passing time may be moved to the second data storage area 62. In this case, the number of data N2 in the second data storage area 62 may reach the predetermined number in a shorter time and the determination of wear and the deterioration of the paper feeding mechanism 2*a* may be started early.

As described above, when the multifeeding occurs at feeding of the sheets, the carrying speed measured under occurrence of the multifeeding is corrected and wear on the paper feeding mechanism is determined. The determination not affected by the multifeeding, therefore, may be performed accurately. Wear and the deterioration status of the paper feeding mechanism may be detected more accurately than the conventional way.

Second Preferred Embodiment

The second preferred embodiment of the present invention is explained next. In the above-described first preferred embodiment, the correction coefficient C is calculated based on the data (passing time) measured at feeding of the paper. The progress of wear and the deterioration of the paper feeding mechanism 2*a* is correlated with the number of the paper fed by the paper feeding mechanism 2*a*. Thus, the correction coefficient C corresponding to the number of the fed paper is calculated in advance, and the calculated correction coefficient C may be stored as information such as a table. In the second preferred embodiment, the correction coefficient C corresponding to the number of the fed paper is stored in advance.

Figure 15:
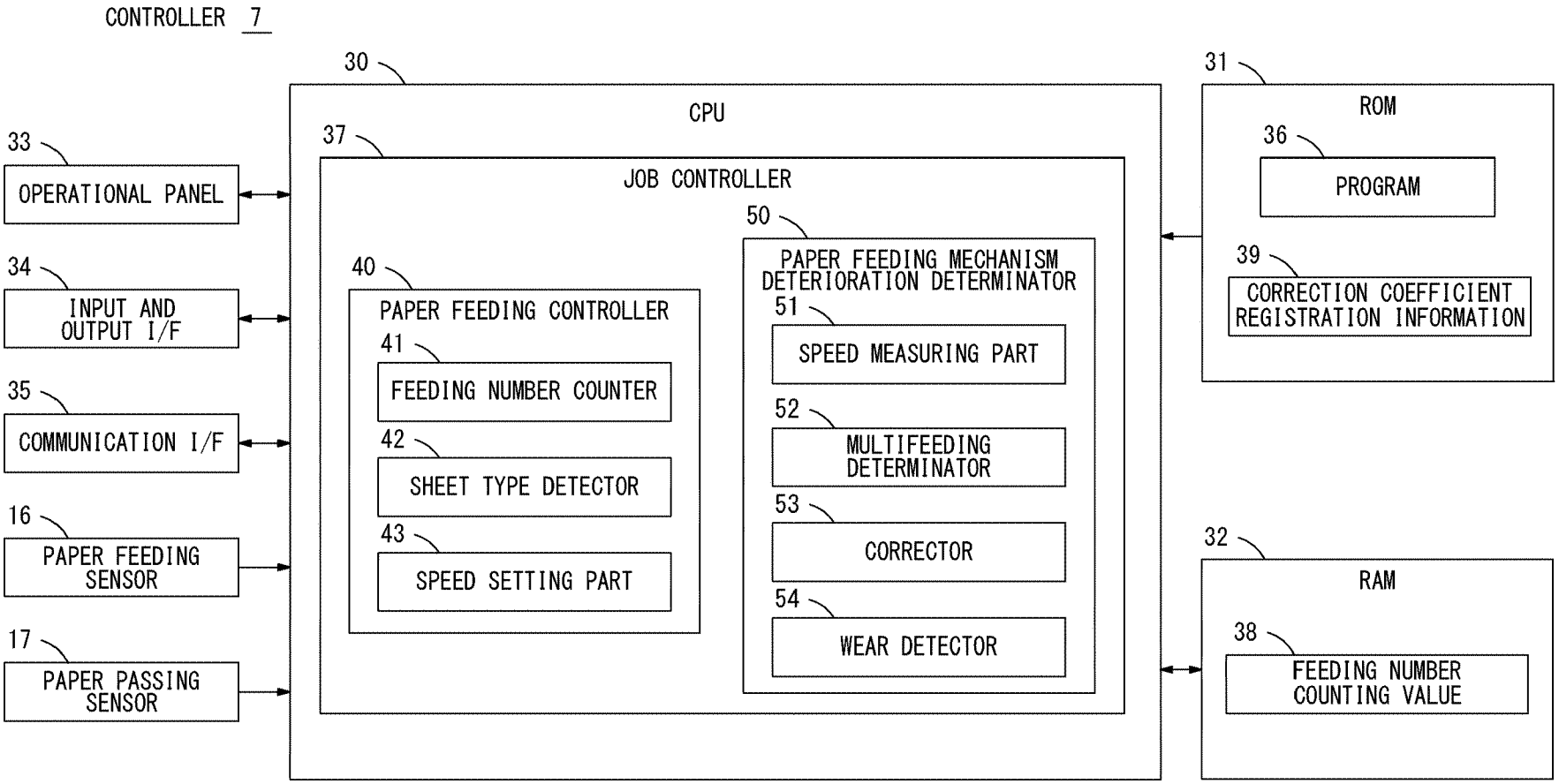
FIG. 15 illustrates a block diagram showing an example of a hardware structure and a functional structure of the controller in which a second preferred embodiment may be practiced.

FIG. 15 illustrates a block diagram showing an example of a hardware structure and a functional structure of the controller 7 in which the second preferred embodiment may be practiced. The difference between the controller 7 of FIG. 15 and the controller 7 of the first preferred embodiment is that correction coefficient registration information 39 is stored in the ROM 31.

FIG. 16 illustrates an example of the correction coefficient registration information 39. As illustrated in FIG. 16, information such as the correction coefficient C and a range of the number of the fed paper to which the correction coefficient C is applied corresponding to each other is stored as the correction coefficient registration information 39. By referring to the correction coefficient registration information 39, the correction coefficient C corresponding to the current number of the fed paper may be obtained. The correction coefficient registration information 39 is stored in advance in the ROM 31 at shipment of products, for instance.

The aforementioned correction coefficient registration information 39 is stored in advance in the ROM 31 so that the controller 7 of the second preferred embodiment is not required to calculate the correction coefficient C. To be more specific, when the multifeeding determinator 52 determines that the multifeeding occurs at the feeding of the previous sheet 9, the corrector 53 refers to the current feeding number counting value 38, and reads the correction coefficient C corresponding to the current number of the fed paper stored as the correction coefficient registration information 39. The corrector 53 reads the passing time of the previous sheet 9 temporarily stored in the RAM 32, and corrects the read passing time based on the correction coefficient C obtained from the correction coefficient registration information 39.

Figure 17:
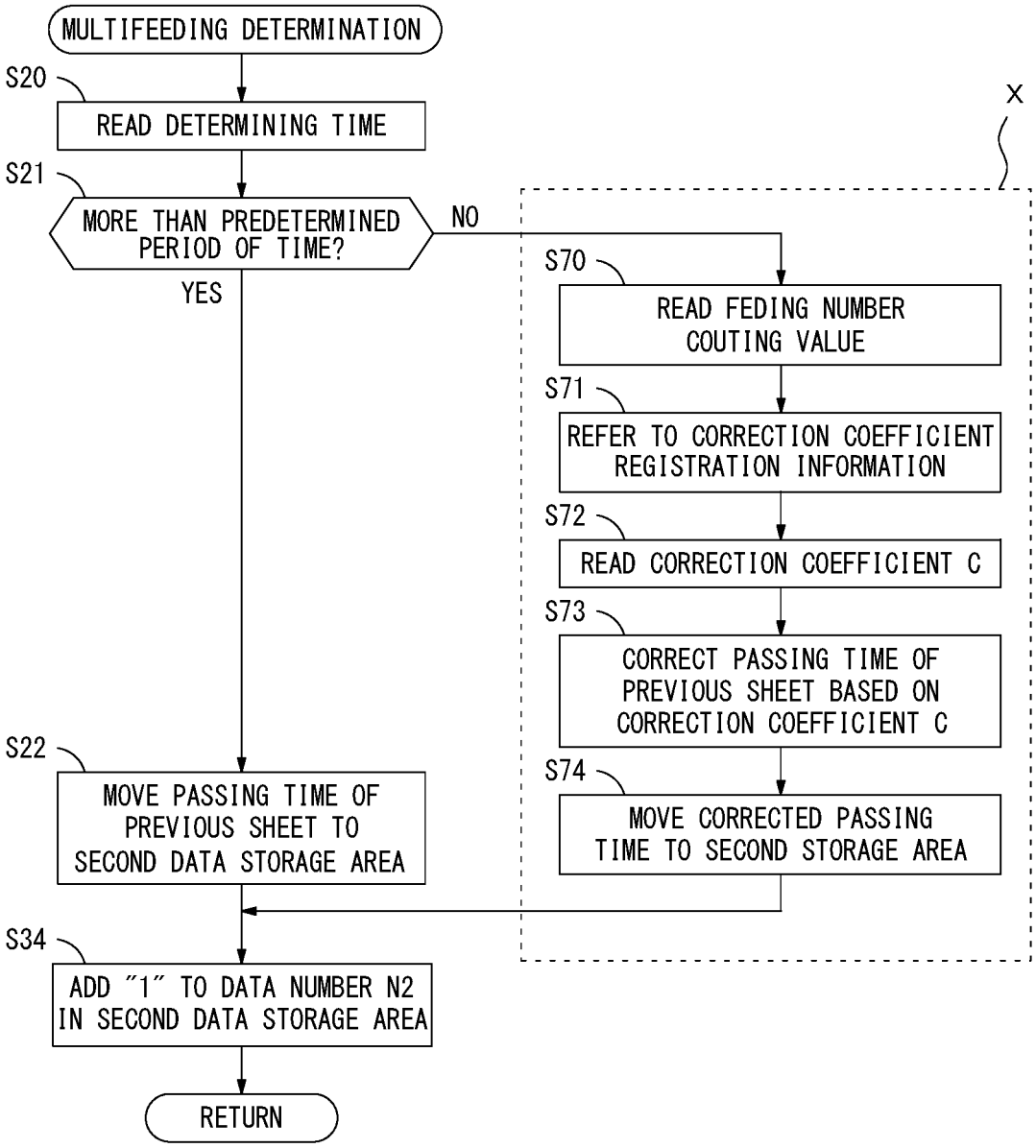
FIG. 17 illustrates a flow diagram explaining an exemplary procedure of the multifeeding determination of the second preferred embodiment in detail.

FIG. 17 illustrates a flow diagram explaining an exemplary procedure of the multifeeding determination (step S5 of FIG. 6) of the second preferred embodiment in detail. The procedure within a broken line shown as X in FIG. 17 is specific to the second preferred embodiment. The controller 7 determines the determining time, and may determine that the multifeeding occurs at the feeding of the previous sheet 9 (when a result of step S21 is NO). The controller 7 then reads the current feeding number counting value 38 (step S70), and refers to the correction coefficient registration information 39 (step S71). The controller 7 is enabled to obtain the correction coefficient C corresponding to the current number of the fed paper (step S72). The controller 7 corrects the passing time of the previous sheet 9 based on the correction coefficient C obtained from the correction coefficient registration information 39 (step S73). As a result the passing time affected by the multifeeding is corrected to the passing time not affected by the multifeeding. The controller 7 stores the corrected passing time in the second data storage area 62 (step S74). As described above, the passing time not affected by the multifeeding is stored in the second data storage area 62, as well as the first preferred embodiment.

As described above, the corrector 53 of the second preferred embodiment reads and obtains the correction coefficient C corresponding to the current number of the fed paper in the ROM 31, and corrects the passing time affected by the multifeeding using the read correction coefficient C. In the second preferred embodiment, it is not necessary to collect the data to calculate the correction coefficient C, and the passing time may be immediately corrected once the multifeeding occurs. A load placed on the CPU 30 to obtain the correction coefficient C may also be reduced.

in the above-described example, the correction coefficient C and the range of the number of the fed paper to which the corresponding correction coefficient C is applied is stored as the correction coefficient registration information 39. However, this is given not for limitation. The correction coefficient C and the range of the number of the fed paper to which the corresponding correction coefficient C is applied may be stored for each type of the sheet 9 and stored as the correction coefficient registration information 39.

FIG. 18 illustrates an example of the correction coefficient registration information 39 as which the correction coefficient C for each type of the sheet 9 is stored. The correction coefficient C is registered for each type of the sheet 9 and stored as the correction coefficient registration information 39 of FIG. 18. The range of the number of the fed paper to which the corresponding correction coefficient C of each type is applied is also stored. After detecting that the type of the sheet 9 is changed, the controller 7 refers to the correction coefficient registration information 39 of FIG. 18 so that it may obtain the correction coefficient C appropriate for the changed type of the sheet 9 and the current number of the fed paper rapidly. Hence, the correction coefficient registration information 39 as illustrated in FIG. 18 may be stored in advance in the ROM 31.

The structures and operations except for the structure and the operation described above in the second preferred embodiment are the same as that in the first preferred embodiment.

Third Preferred Embodiment

The third preferred embodiment of the present invention is explained next. As described above, once the type of the sheet 9 fed by the paper feeding mechanism 2*a* is changed, the carrying speed of the sheet 9 may also be changed. In the third preferred embodiment, the correction coefficient C corresponding to the carrying speed (feeding speed) of the sheet 9 is kept.

FIG. 19 illustrates an example of the relation between the type of the sheet 9 and the carrying speed. A speed reduction setting may be configured with the image forming device 1 of FIG. 19. The speed reduction setting is applied, for instance, when the print job executed by the image forming device 1 is to produce printed outputs using the multiple types of the sheets 9. On and off may be configured as the speed reduction setting. When the speed reduction setting is off, the carrying speed appropriate for the changed type of the sheet 9 is set as usual once the type of the sheet 9 is changed during processing of the print job. When the speed reduction setting is off, the multiple types of sheets 9 are carried to realize the maximum throughput at processing of the print job. When the speed reduction setting is on, the carrying speed corresponding to the type of the sheet 9 is set one or multiple levels lower. When the speed reduction setting is on, a load to change the type of the sheet 9 at the image forming device 1 may be reduced. The speed down setting is configured in advance by the user.

It is assumed that the speed reduction setting is off when the type of the sheet 9 is a plain paper. In this case, according to the example of FIG. 19, the carrying speed is high. When the speed reduction setting is on, the carrying speed is medium. It is assumed that the type of the sheet 9 is the thick paper 1. In this case, the carrying speed is medium when the speed reduction setting is off, and the carrying speed is low when the speed reduction setting is on. This is the same when the sheet 9 is the thick paper 2 which is thicker than the thick paper 1. The carrying speed is medium when the speed reduction setting is off, and the carrying speed is low when the speed reduction setting is on. If the print job is not using the multiple types of the sheets 9, the carrying speed the same value as that applied when the carrying reduction setting is off is applied.

When the above-described speed reduction setting is configured, the correction coefficient C appropriate for the actual carrying speed of the sheet 9 cannot be applied if just the correction coefficient C corresponding to the type of the sheet 9 is stored as described in the first and the second preferred embodiments. The image forming device 1 of the third preferred embodiment is configured to store the correction coefficient C corresponding to the carrying speed of the sheet 9 set by the speed setting part 43. To be more specific, the corrector 53 of the controller 7 manages the correction coefficient C for each carrying speed of the sheet 9.

The corrector 53 stores the passing time of the previous sheet 9 in the first data storage area 61 when the multifeeding determinator 52 determines the multifeeding occurs at feeding of the previous sheet 9, as well as in the first preferred embodiment. When the number of data N1 in the first data storage area 61 reaches equal to or more than the predetermined number, the corrector 53 calculates the correction coefficient C based on the predetermined number of data (passing time). The corrector 53 manages the carrying speed of the sheet 9 and the corresponding correction coefficient C. Every time the setting of the carrying speed of the sheet 9 changes, the corrector 53 collects the data (passing time) under the occurrence of the multifeeding and calculates the correction coefficient C corresponding to the carrying speed. The corrector 53 manages the carrying speed and the correction coefficient C corresponding to the carrying speed. More specifically, the correction coefficient C is managed for each carrying speed configurable with the image forming device 1.

FIG. 20 illustrates an example of the information including the carrying speed and the correction coefficient C corresponding to the carrying speed. As illustrated in FIG. 20, the controller 7 stores the carrying speed (feeding speed) of the sheet 9, the correction coefficient C and the feeding number counting value obtained at calculation of the corresponding correction coefficient C in the ROM 32. The carrying speed (feeding speed) of the sheet 9, the correction coefficient C and the feeding number counting value corresponding to each other are managed by the controller 7. In the example of FIG. 20, three types of the speed including high speed, medium speed and low speed are stored as the information that may be registered corresponding to the correction coefficient C.

After changing the setting of the carrying speed of the sheet 9, the controller 7 reads the correction coefficient C corresponding to the carrying speed in the information of FIG. 20 if the correction coefficient C corresponding to the carrying speed has already been calculated. The controller 7 then corrects the passing time measured under occurrence of the multifeeding based on the read correction coefficient C. The controller 7 determines if the number of the fed paper after calculation of each correction coefficient C exceeds the predetermined number (for instance, 5000) based on the feeding number counting value obtained at calculation of each correction coefficient C. When the number of the fed paper exceeds the predetermined number, the controller 7 resets the correction coefficient C. In other words, the controller 7 uses the correction coefficient C which had been used previously to correct the passing time if the correction coefficient C has already been calculated and the number of the fed paper after the calculation of the correction coefficient C is less than the predetermined number (for instance, 5000) when the carrying speed of the sheet 9 is changed. The correction coefficient C corresponding to each caring speed of the sheet 9 is stored as described above. As a result, the correction coefficient C does not have to be calculated again if the correction coefficient C corresponding to the changed carrying speed has already been calculated when the carrying speed is changed.

In the example described above, the corrector 53 calculates the correction coefficient C, as well as in the first preferred embodiment. However, this is given not for limitation. The correction coefficient C corresponding to the number of the fed paper may be calculated in advance and stored as the information such as a table as described in the second preferred embodiment.

FIG. 21 illustrates an example of the correction coefficient registration information 39 as which the correction coefficient C is registered in advance for each carrying speed. The correction coefficient registration information 39 of FIG. 21 includes the correction coefficient C registered for each carrying speed of sheet 9. The correction coefficient C of each carrying speed also corresponds to the range of the number of the fed paper. Once the setting of the carrying speed of the sheet 9 is changed, the controller 7 refers to the correction coefficient registration information 39 of FIG. 21 and is enabled to obtain rapidly the correction coefficient C appropriate for the changed carrying speed and the current number of fed paper. Hence, the correction coefficient registration information 39 of FIG. 21 may be stored in advance in the ROM 31.

The structures and operations except for the structure and the operation described above in the third preferred embodiment are the same as that in the first or the second preferred embodiment.

When the carrying speed (feeding speed) of the sheet 9 is changed, the predetermined period of time used by the multifeeding determinator 52 to determine if the determining time is more than the predetermined period of time is preferably changed in accordance with the carrying speed. It is assumed, for example, the paper such as a plain paper which is carried in high speed may be placed. In this case, the predetermined period of time may be set at 200 ms. When the paper such as a thick paper which is carried in medium speed is placed, the predetermined period of time may be set at 220 ms. When the thick paper is carried in low speed, the predetermined period of time may be set at 240 ms. As described above, it is preferable to configure the setting corresponding to the carrying speed.

Although the embodiments of the present invention have been described and illustrated in detail, it is clearly understood that the same is by way of illustration and example only and not limitation, the scope of the present invention should be interpreted by terms of the appended claims.

(Modifications)

While the preferred embodiments of the present invention have been described above, the present invention is not limited to the preferred embodiments. Various modifications may be applied to the present invention.

In the above-described preferred embodiments, for example, the sheet type detector 42 reads the type of the sheet 9 set by the user and detects the type of the sheet 9 to feed. However, this is given not for limitation. The sheet type detector 42 does not always have to detect the type of the sheet 9 based on the user operation. A light sensor may be provided with the carrying path 11 of the sheet 9, for example, and the light sensor may irradiates a light to the carried sheet 9. The sheet type detector 42 may automatically detect the type of the sheet 9 based on a transmittance or reflectivity of the light detected by the light sensor.

The program 36 of the above-described preferred embodiments executed by the CPU 30 is stored in advance in the ROM 31. The program 36 may be installed in the image forming device 1 via the communication interface 35, for example. In this case, the program 36 may be provided over an internet in a manner that enables a user to download, or may be provided in a manner that is recorded on a computer readable recording medium such as a CD-ROM or a USB memory.

In the above-described preferred embodiments, the correction coefficient C is updated every time the number of the fed paper exceeds 5000 as an example. The timing to update the correction coefficient C does not always have to be the time when the number of the fed paper exceeds 5000. The correction coefficient C may be updated every time the number of the fed paper exceeds 1000 or may be updated every time the number of the fed paper exceeds 100.

What is claimed is:

1. An image forming device comprising:

a tray in which multiple number of sheets are stored;

a feeder that feeds one of the sheets stored in the tray; and a hardware processor that:

measures a carrying speed of the sheet fed by the feeder;

determines whether or not the measured carrying speed is affected by a following sheet;

corrects the carrying speed upon determining the carrying speed is affected by the following sheet; and detects a wear status on the feeder based on the measured carrying speed or the corrected carrying speed.

2. The image forming device according to claim 1, wherein the feeder comprises:

a paper feeding roller that is in contact with an upper surface of the fed sheet and carries the fed sheet toward downstream; and a separation roller that is arranged opposite the paper feeding roller and separates the following sheet from the fed sheet by working together with the paper feeding roller.

3. The image forming device according to claim 2, wherein the feeder further comprises:

a pick-up roller that picks up sheets stored in the tray, and the paper feeding roller is arranged downstream of the pick-up roller and carries the sheets carried by the pick-up roller to further downstream.

4. The image forming device according to claim 1, wherein when a time between a time the feeder starts feeding the following sheet and a time the following sheet passes a predetermined position in downstream of the feeder is less than a predetermined period of time, the hardware processor determines that the measured carrying speed is affected by the following sheet.

5. The image forming device according to claim 1, wherein the hardware processor further:

calculates an average of the carrying speeds of the predetermined number of sheets after the predetermined number of sheets are fed by the feeder; and detects wear status on the feeder based on the calculated average.

6. The image forming device according to claim 1, wherein the hardware processor further:

calculates a correction coefficient to correct the carrying speed affected by the following sheet to the carrying speed not affected by the following sheet; and corrects the measured carrying speed using a calculated correction coefficient.

7. The image forming device according to claim 6, wherein the hardware processor further:

counts the number of sheets fed by the feeder, wherein upon counting a predetermined number of fed sheets, the hardware processor updates the correction coefficient.

8. The image forming device according to claim 7, wherein the hardware processor further:

detects a type of the sheet fed by the feeder, wherein when the counted number of fed sheets does not reach the predetermined number of the fed sheets upon detecting the change made in the type of the sheet, the hardware processor corrects the measured carrying speed using the correction coefficient previously used for the type of the sheet.

9. The image forming device according to claim 7, wherein the hardware processor further:

sets a feeding speed of the sheet applied to the feeder, and when the counted number of fed sheets does not reach the predetermined number of fed sheets upon making a change in the setting of the feeding speed, the hardware processor corrects the measured carrying speed using the correction coefficient previously used for the feeding speed.

10. The image forming device according to claim 6, wherein the hardware processor further:

detects a type of sheet fed by the feeder, wherein upon detecting a change made in the type of the sheet, the hardware processor updates the correction coefficient.

11. The image forming device according to claim 6, wherein the hardware processor further:

sets a feeding speed of the sheet to apply to the feeder, and upon making a change in the setting of the feeding speed, the hardware processor updates the correction coefficient.

12. The image forming device according to claim 1, wherein the hardware processor further:

reads and obtains a correction coefficient to correct the carrying speed affected by the following sheet to the carrying speed not affected by the following sheet stored in a predetermined storage; and corrects the measured carrying speed using the obtained correction coefficient.

13. A paper feeding mechanism deterioration determining method to determine a deterioration of a paper feeding mechanism, the method applied at an image forming device provided with the paper feeding mechanism that feeds a sheet, the method comprising:

measuring a carrying speed of the sheet fed by the paper feeding mechanism;

determining whether or not the measured carrying speed is affected by a following sheet;

correcting the carrying speed upon determining that the carrying speed is affected by the following sheet; and detecting a wear status on the paper feeding mechanism based on the measured carrying speed or the corrected carrying speed.

14. The paper feeding mechanism deterioration determining method according to claim 13, wherein when a time between a time the paper feeding mechanism starts feeding the following sheet and a time the following sheet passes a predetermined position in downstream of the paper feeding mechanism is less than a predetermined period of time, the hardware processor determines that the measured carrying speed is affected by the following sheet.

15. The paper feeding mechanism deterioration determining method according to claim 13, wherein the method further comprises:

calculating an average of carrying speeds of a predetermined number of sheets after the predetermined number of sheets are fed by the paper feeding mechanism; and detecting wear status on the paper feeding mechanism based on the calculated average.

16. The paper feeding mechanism deterioration determining method according to claim 13, wherein the method further comprises:

calculating a correction coefficient to correct the carrying speed affected by the following sheet to the carrying speed not affected by the following sheet; and correcting the measured carrying speed using the calculated correction coefficient.

17. The paper feeding mechanism deterioration determining method according to claim 16, wherein the method further comprises:

counting a number of sheets fed by the paper feeding mechanism, wherein upon a predetermined number of fed sheets is counted, the correction coefficient is updated.

18. The paper feeding mechanism deterioration determining method according to claim 17, wherein the method further comprises:

detecting a type of the sheet fed by the paper feeding mechanism, wherein when the counted number of the fed sheet does not reach a predetermined number of fed sheets upon a change made in the type of the sheet is detected, the measured carrying speed is corrected using the correction coefficient previously used for the type of the sheet.

19. The paper feeding mechanism deterioration determining method according to claim 17, wherein the method further comprises:

setting a feeding speed of the sheet applied to the paper feeding mechanism, wherein when the counted number of fed sheets does not reach the predetermined number of the fed sheet upon a change made in the feeding speed is detected, the measured carrying speed is corrected using the correction coefficients previously used for the feeding speed.

20. The paper feeding mechanism deterioration determining method according to claim 16, wherein the method further comprises:

detecting a type of the sheet fed by the paper feeding mechanism, wherein upon a change made in the type of the sheet is detected, the correction coefficient is updated.

21. The paper feeding mechanism deterioration determining method according to claim 16, wherein the method further comprises:

setting a feeding speed of the fed sheet to apply to the paper feeding mechanism, wherein upon a change made in the feeding speed is detected, the correction coefficient is updated.

22. The paper feeding mechanism deterioration determining method according to claim 13, wherein the method further comprises:

reading and obtaining a correction coefficient to correct the carrying speed affected by the following sheet to the carrying speed not affected by the following sheet stored in a predetermined storage; and correcting the measured carrying speed using the obtained correction coefficient.

23. A non-transitory recording medium storing a computer readable program to be executed by a hardware processor in an image forming device provided with a paper feeding mechanism that feeds a sheet, the hardware processor executing the computer readable program to perform:

measuring a carrying speed of the sheet fed by the paper feeding mechanism;

determining whether or not the measured carrying speed has been affected by a following sheet;

correcting the carrying speed upon determining the carrying speed is affected by the following sheet; and detecting a wear status on the paper feeding mechanism based on the measured carrying speed or the corrected carrying speed.

* * * * *